United States Patent [19]

Doi et al.

[11] 4,045,135

[45] Aug. 30, 1977

[54] ELECTROPHOTOGRAPHIC COPYING APPARATUS WITH RETRACTABLE IMAGE TRANSFER ROLLER MEANS

[75] Inventors: Yasuhiko Doi, Toyokawa; Shunji Yamamoto, Shinshiro; Osamu Okada, Toyokawa; Takashi Hikosaka, Atsumi; Masamichi Hayashi, Minami Shidara, all of Japan

[73] Assignee: Minolta Camera Kabushiki Kaisha, Osaka, Japan

[21] Appl. No.: 611,874

[22] Filed: Sept. 10, 1975

Related U.S. Application Data

[63] Continuation-in-part of Ser. No. 500,171, Aug. 23, 1974, Pat. No. 3,997,262.

[30] Foreign Application Priority Data

Sept. 7, 1973 Japan ..... 48-101372
Apr. 30, 1975 Japan ..... 50-52826

[51] Int. Cl.[2] ..... G03G 15/00

[52] U.S. Cl. ..... 355/11; 355/3 R; 355/14

[58] Field of Search ..... 355/3 R, 3 DR, 3 TE, 355/8, 11, 14

[56] References Cited

U.S. PATENT DOCUMENTS 3,824,012 7/1974 Iizaka et al. ..... 355/3 TE
3,834,810 9/1974 Kurokawa et al. ..... 355/3 TE

*Primary Examiner*—George H. Miller, Jr.
*Attorney, Agent, or Firm*—Wenderoth, Lind & Ponack

[57] ABSTRACT

In a transfer type electrophotographic copying apparatus which comprises a reciprocating platform for supporting an original to be copied, a rotatable photoreceptor drum of a small diameter, and processing devices of small size disposed around the photoreceptor drum for compact size of the copying apparatus, an improved transfer device and a transferred image disturbance prevention device are further included for efficient copying operations.

3 Claims, 28 Drawing Figures

1'
3'
226
226a
67'
fp
30'
247
211
210
217
217a
220
221
222
233
ℓ

ELECTROPHOTOGRAPHIC COPYING APPARATUS WITH RETRACTABLE IMAGE TRANSFER ROLLER MEANS

This application is a continuation-in-part of our copending application Ser. No. 500,171, filed on Aug. 23, 1974, and entitled, Electrophotographic Copying Apparatus, now U.S. Pat. No. 3,997,262.

BACKGROUND OF THE INVENTION

The present invention relates to a copying apparatus and, more particularly to a transfer type electrophotographic copying apparatus with a movable platform to support an original to be copied.

Conventionally, in a copying apparatus of the above described type, there is usually employed a copying system known as the Carlson system, in which an electrostatic latent image formed on an electrophotosensitive photoreceptor in the configuration of a drum or an endless belt is subsequently visualized by applying thereto a developing material in the form of power or liquid for the transfer of the visualized image onto a copy paper sheet, or another system wherein the latent image formed on the photoreceptor is directly transferred onto a copy paper sheet without visualization, with the latent image transferred onto the copy paper sheet subsequently developed for obtaining the copy of the original.

In the copying apparatus of the above described types, however, despite the long felt need for compact size and simple handling, there has been none which completely satisfies such needs.

In other words, in the conventional visualized image transfer type copying apparatus as described above, it is necessary to dispose various processing devices, such as a corona charger, an exposure device, a developing device, a transfer device, a copy paper sheet separating device, charge erasing devices and a cleaning device etc., around the photoreceptor, which arrangement inevitably results in a large size of the photoreceptor itself and complicated construction of the copying apparatus as a whole with consequent troublesome maintenance, while in the latter type system which develops the latent image transferred onto the copy paper sheet, no copying apparatus sufficiently fit for practical use has been developed as yet, though this latter type of copying apparatus can eliminate the disadvantages inherent in the former type since the developing device need not be located around the photoreceptor.

Furthermore, in the latter type of copying apparatus wherein the latent image formed on the photoreceptor is directly transferred onto the copy paper sheet, the copy sheet is fed in synchronization with the movement of the latent image on the photoreceptor drum, while the copy paper is pressed, at the transfer station, against the photoreceptor surface by an electrically conductive roller or a grounded roller so as to induce a charge having the same polarity as that of the latent image on an insulating layer of the copy paper sheet for transferring the latent image onto the copy paper sheet. In such case, if the copy paper sheet is directly fed between the photoreceptor surface of the photoreceptor drum and the grounded roller, a phenomenon similar to that in rapid generation of a strong electric field between the leading edge of the latent image formed portion on the photoreceptor drum surface and the grounded roller is observed, such a phenomenon giving rise to white spots or absence of black tone in the developed image due to undesirable electrical discharge between the photoreceptor drum surface and the reverse side of the copy paper sheet in a position, immediately before the copy paper sheet contacts the latent image formed portion on the photoreceptor surface, where the gap between the photoreceptor drum surface and the copy paper sheet is larger than the gap whereat the transfer is normally carried out. To eliminate the disadvantages as described above, there is conventionally proposed a method wherein the copy sheet is caused to contact the photoreceptor drum surface before the former is pressed against the latter by the grounded roller, in which method the copy paper sheet initially pressed against the photoreceptor drum surface by an electrically insulating roller is subsequently fed between the neighboring grounded roller and the photoreceptor surface. The above described conventional arrangement is effective for preventing generation of the white spots or absence of black tone in the developed image, since the surface of the insulating roller insulated from the copying apparatus housing is in an electrically isolated condition, with the surface potential of the former being varied according to the potential of the latent image formed portion when the latent image formed portion on the photoreceptor drum approaches the insulating roller as the photoreceptor drum rotates. In other words, in the above described conventional arrangement, transfer of the high potential part of the latent image formed portion is nearly completed at the portion of the insulating roller without generating the strong electric field between the copy paper sheet and the photoreceptor drum surface or the electrical discharge therebetween. In such case, however, there must be a certain distance between the insulating roller and the grounded roller, since if the distance between the two rollers is excessively small with respect to the copy paper sheet, the portion of the copy paper sheet whose reverse surface has electrical conductivity to a certain extent and which contacts the insulating roller is electrically connected to the grounded roller, thus giving rise to the absence of black tone in the developed image. However, separating the two rollers to a suitable extent from each other requires means for positively keeping the copy paper sheet in contact with the photoreceptor drum surface between the same rollers, because the charge on the photoreceptor drum surface after exposure is rather weak for positively holding the copy paper sheet on the photoreceptor drum surface, and especially when a photoreceptor drum of a small diameter is employed, it is extremely difficult to hold the copy paper sheet on the drum surface by the electrostatic attracting force alone.

In order to overcome disadvantages as described above, there are proposed transfer devices wherein a plurality of narrow belts of insulating nature such as rubber are directed around the insulating roller and the grounded roller as disclosed in parent application Ser. No. 500,171 or wherein a guide member is provided between the two rollers for preventing the copy paper sheet from coming off the photoreceptor surface. The former such device, however, still has a tendency such that the state under which the copy paper sheet contacts the photoreceptor surface tends to differ from one portion to another, thus resulting in fogging or blurring at the trailing edge of the developed image on the copy paper sheet, while in the latter such device, the guide member itself has no positive effect for holding the copy paper sheet on the photoreceptor drum surface, thus tending to cause jamming of the copy paper sheet.

SUMMARY OF THE INVENTION

Accordingly, an essential object of the present invention is to provide an electrophotographic copying apparatus which is equipped with an improved transfer device in addition to being compact of size and light in weight.

Another important object of the present invention is to provide an electrophotographic copying apparatus of the above described type having an improved transfer device which is accurate in functioning and simple in construction for providing a clear and definite transferred image of the original without fogging or blurring.

A further object of the present invention is to provide an improved transfer device of the above described type which can readily be incorporated in copying apparatuses both of the wet developing process type and of the dry developing process type.

A still further object of the present invention is to provide an electrophotographic copying apparatus of the above described type which is further provided with a device for preventing disorder of the transferred image and with fixing device for efficient copying operations.

According to the copying apparatus of the present invention, various devices, such as devices for corona charging, exposure, transfer, and charge erasing, etc., are made compact in size, each of which devices is efficiently disposed around the photoreceptor drum with minimum necessary space therebetween, thus making it possible to adapt the photoreceptor drum to be of a small diameter. At least part of the surface of the photoreceptor drum is adapted to form the latent image more than one time during one copying operation, and a slit exposure type optical system with a movable platform for supporting an original thereon, in which the light path from the original to be copied to the photoreceptor surface on the drum is arranged to cross one time at a predetermined position, is employed for use with the small sized photoreceptor drum, so that the distance between the platform and the photoreceptor drum is minimized and consequently the size of the copying apparatus can be reduced to a size approximately equal to that of a small, so called Electrofax type, copying apparatus.

Furthermore, the housing of the apparatus of the invention is adapted to be divided into two portions, i.e., an upper frame including the latent image forming means, and a lower frame including devices for copy paper feeding, transfer, developing and fixing, etc., with the upper frame pivotally connected to the lower frame for raising the former about the pivotal connection, by which arrangement the interior mechanisms of the copying apparatus are easily accessible. Thus replacement and maintenance of the photoreceptor drum or other machine parts are possible very efficiently.

Additionally, the copying apparatus of the present invention is characterized by the inclusion of an improved transfer device wherein, instead of the insulating roller conventionally employed for the transfer operation, a guide plate member of electrically insulating nature is provided in a position immediately before the conductive grounded roller for causing the plate member to perform the same functions as in the insulating roller so that the copy paper sheet is efficiently guided toward the grounded roller with substantial elimination of the disadvantages inherent in the conventional transfer devices.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Before the description of the present invention proceeds, it is to be noted that like parts are designated by like numerals throughout the several views of the accompanying drawings.

Figure 1:
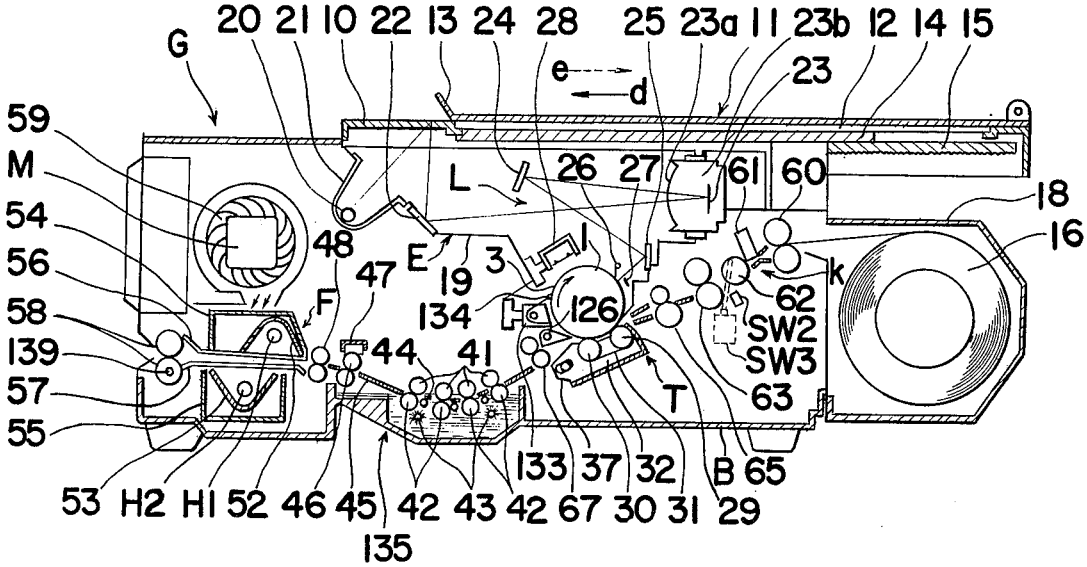
FIG. 1 is a schematic diagram showing a sectional side view of a copying apparatus according to the present invention.

Referring to FIGS. 1 through to 11, the transfer type electrophotographic copying apparatus of the present invention with a movable platform to receive thereon an original to be copied generally comprises a drum 1 having a photoreceptor surface 3 on the outer periphery thereof and rotatably mounted on a shaft journaled in the frame of the apparatus housing G to rotate in the direction indicated by an arrow to cause the photoreceptor surface 3 to sequentially pass various processing stations disposed therearound, such as a charging station with a corona discharger 28, a slit exposure station associated with a slit exposure device E and a transfer station having a transfer device T. The device also broadly comprises horizontally movable platform 11 provided above the drum 1 and reciprocatingly supported at the upper portion of the housing G, a copy paper feeding device including a plurality of rollers and a copy paper roll 16 rotatably enclosed in a casing 18, a developing device D disposed at the left and below the drum 1, and a drying and fixing device F for copy paper sheets disposed subsequent to the developing device D.

The movable platform 11 on which is placed the original to be copied further includes a frame 10 which has a transparent support platen 12 set therein, for example of glass, a platen cover 13 pivotally secured on the frame 10 so as to cover the platen 12 with the original to be copied therebetween, a pair of guide rails 14 for reciprocating the platform 11 and a rack 15 for transmitting a driving force from a driving means.

The image rays from the original placed on the platform 11 are directed onto the photoreceptor 3 on the drum 1 through the slit exposure device E fixedly provided between the platform 11 and the photoreceptor drum 1.

The slit exposure device E enclosed, for shielding unnecessry light, in an optical frame 19 suitably fixed to the apparatus housing G includes a light source 20, for example, a halogen lamp or fluorescent lamp having a reflecting shade 21 for illuminating the original to be copied, a slit optical system L comprising a first mirror 22 fixedly provided below the platform 11 and inclined at approximately 45° with respect to the lower surface of platform 11 for directing the light rays from the original to a second mirror 23 through a lens **23*a* enclosed in a lens tube 23*b*, and a third mirror 24 fixedly provided immediately below the platform 11 and suitably inclined so as to direct the light rays reflected by the mirror 23 through the lens 23*a* to a fourth mirror 25 secured in the optical frame 19 adjacent to the drum 1, which mirror 25 in turn directs the light images from the original onto the photoreceptor surface 3 through a slit adjusting vane 26 and a plate 27 which eliminates uneven exposure and which are disposed adjacent to the image forming portion on the photoreceptor 3.**

It should be noted here that, in the above optical system L, the light path between the first mirror 22 and the second mirror 23 through the lens **23*a* is adapted to intersect the light path between the third mirror 24 and the fourth mirror 25 so that the space required for the optical system i.e., mainly the distance between the platform 11 and the photoreceptor drum 1,** is reduced to a large extent.

The photoreceptor drum 1 has a small diameter, for example, in the range of approximately 50 to 100 mm.

Although the conventional photoreceptor drum had a minimum size of approximately 120 mm in diameter, the present inventors confirmed that a photoreceptor drum having a small diameter in the range of 50 to 100 mm has an efficient copying performance without any optical distortion of the formed images, after repeated experiments and trial productions, also taking into consideration the relationship of the photoreceptor drum to other processing devices mentioned later, which findings greatly contribute to the reduction of the size of the copying apparatus.

Referring particularly to FIG. 1, the corona charger 28 is fixedly mounted, above the photoreceptor drum 1, adjacent to the electrophotosensitive photoreceptor layer 3 (FIG. 11) on the drum 1 for uniformly charging the layer 3. The image rays from the original to be copied are projected onto the layer 3 through the slit exposure device E which sequentially scans the original placed on the platform 11, moving in a scanning direction with a resultant electrostatic latent image corresponding to the image of the original formed on the photoreceptor layer 3.

Figure 3:
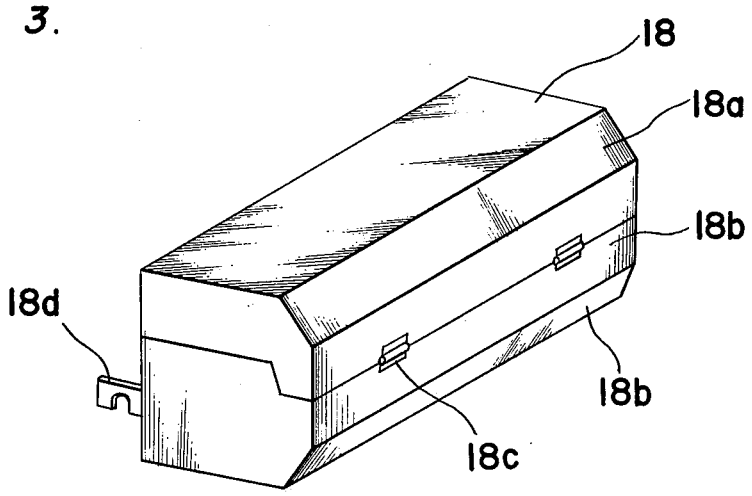
FIG. 3 is a perspective view of a casing for a roll of copy paper employed in the apparatus of FIG. 1 with the casing removed from the copying apparatus.
Figure 4:
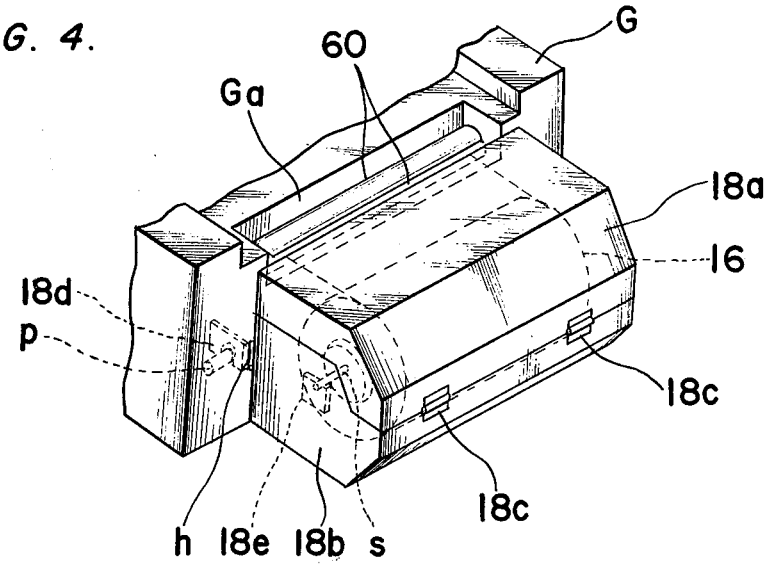
FIG. 4 is a similar view to FIG. 3, but with the casing attached to the copying apparatus.

Referring to FIGS. 3 and 4, a roller 16 of copy paper is rotatably supported in a casing 18 releasably attached to the rear side wall of the apparatus housing G (FIG. 1). The casing 18 made, for example, of transparent plastic material comprises an upper casing **18*a* and an lower casing 18*b* connected together by hinges 18*c* so that the upper casing 18*a* can be raised or lowered about the hinges 18*c*.**

It should be noted here that the material for the casing 18 need not necessarily be totally transparent, but may be partially transparent when observed from a proper angle, or semitransparent, or may be simply provided with a suitable opening for viewing.

A pair of metal pieces **18*d*** for engaging with pins *p* secured to the apparatus housing G are fixedly attached to the opposite side walls of the lower casing **18*b* with one end of each metal piece 18*d* projecting to a certain extent from the edge of the side wall of the lower casing 18*b*** facing the housing G.

The casing 18 is adapted to be attached to the apparatus housing G with the projecting ends of the metal pieces **18*d*** inserted into openings *h* formed in the corresponding wall of the housing G and subsequently hooked on the pins *p*.

The roll 16 of the copy paper is mounted on a shaft S which is releasably supported by a pair of bearing plates **18*e* secured to the opposite side walls of the lower casing 18*b*.**

A pair of first rollers 60 exposed from the apparatus housing G are provided for feeding a web of copy paper from the roll 16 into the apparatus G and are partially surrounded by a cover G*a* of the housing G for shielding unnecessary light. When the leading edge of the paper web from the roll 16 is inserted between the first rollers 60, the copy paper is adapted to be continuously fed into the copying apparatus G as the subsequent copying operation begins. If labels showing paper sizes B4, A4, B5 and A5 etc., are affixed on the casing 18, the size of the copy paper sheet can be readily identified by comparing the length of the copy paper sheet with such labels.

As described above, the above casing 18 of the invention is not only capable of confirming the presence and the sizes of the copy paper sheets very easily, but is also very advantageous in reducing the size of the copying apparatus, since the casing 18 is releasably attached to the outer side wall of the apparatus for easy handling.

Moreover, since the roll 16 of the copy paper enclosed in the casing 18 is wound with its photosensitive surface outward, the resultant curling of the copy paper to a certain extent is effective for making it very easy to separate the copy paper sheet from the photoreceptor surface 3 of the drum 1, as will be described later.

Referring back to FIG. 1, the paper web from the roll 16 is fed to the transfer device T through the first rollers 60, a cutting device *k* having a stationary blade 61 an rotatory blade 62 for cutting the paper web to a required size, a pair of loop forming rollers 63 for cutting the paper web in a state of tension and another pair of second rollers 65 for feeding the cut copy sheet into the transfer device T.

During the above feeding operation, the copy paper feeding speed of the above loop forming rollers 63 is adapted to be faster than that of the first rollers 60 (actually a speed ratio in the range of 1.05 to 1.2 times is suitable), and a one-way clutch 94 (FIG. 2) is mounted on a shaft of one of the first rollers 60 so that, after the leading edge of the web of copy paper has reached the loop forming rollers 63, the feeding speed of the first rollers 60 follows that of the loop forming rollers 63, in which case the first rollers 60 rotate by the pull of the rollers 63 through the copy paper sheet.

Furthermore, the feeding speed of the loop forming rollers 63 is adapted to be faster than that of the second rollers 65, whereby the copy paper sheet is fed in the form of a loop between the rollers 63 and rollers 65.

For cutting the web of copy paper into a copy paper sheet of desired size, the rotations of the first rollers 60 and loop forming rollers 63 are stopped with the roller 65 rotating, by a signal from paper cut swithc $SW_6$ (FIG. 12) actuated as the platform 11 advances in the direction shown by arrow *d*, and simultaneously a solenoid $SL_3$ is actuated to turn the rotatory blade 62 so as to cut the web of paper between the rotatory blade 62 and the stationary blade 61.

During the above cutting process, the second rollers 65 keep rotating, whereby the copy paper sheet being fed through the second rollers 65 is continuously fed without stopping because of the presence of the loop formed between the rollers 63 and the second rollers 65. Although the loop forming rollers 63 are not being driven as the first rollers 60 after the web of copy paper has been cut, a one way clutch 93 (FIG. 2) mounted on a shaft of one of the rollers 63 allows the rollers 63 to rotate following the feeding speed of the second rollers 65 through the copy paper sheet after the loop therebetween has disappeared.

A platform lock releasing switch $SW_2$ is disposed behind the cutting device K in such an operating position that, when the copy paper sheet has reached the transfer device T, the position of the copy paper sheet coincides with the position of the latent image formed on the photoreceptor drum 1. When the leading edge of the copy paper sheet reaches the releasing switch $SW_2$, the signal therefrom is adapted to move the platform 11 to form the electrostatic latent image on the photoreceptor surface 3 of the drum 1.

The latent image thus formed is subsequently transferred onto the copy paper sheet which is fed to the transfer device T in synchronization therewith.

Figure 5:
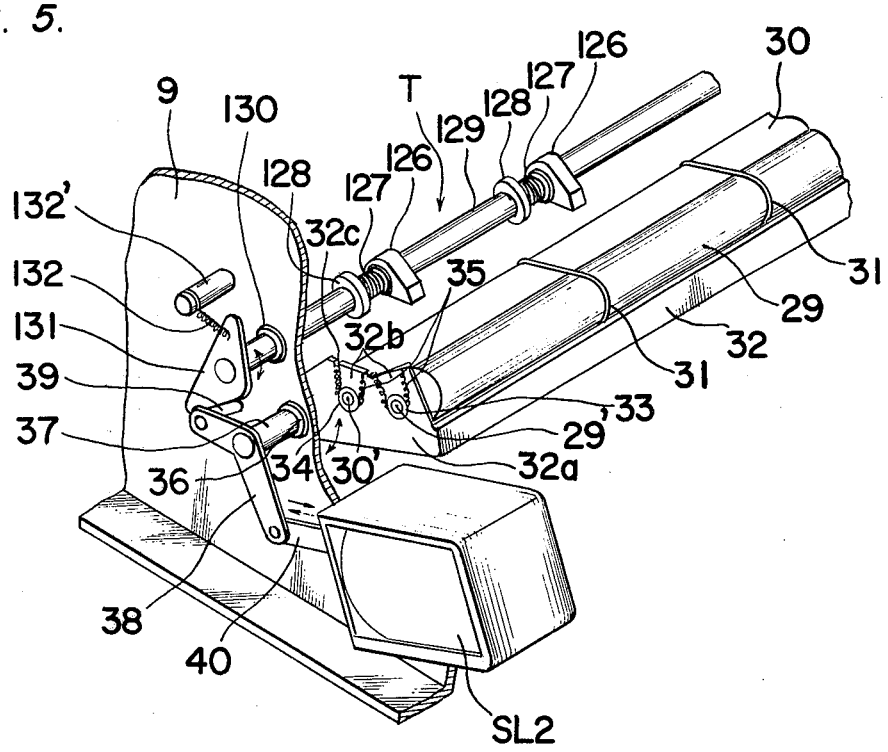
FIG. 5 is a perspective view, on an enlarged scale, of a transfer device and associated mechanism therewith employed in the copying apparatus of FIG. 1.
Figure 6:
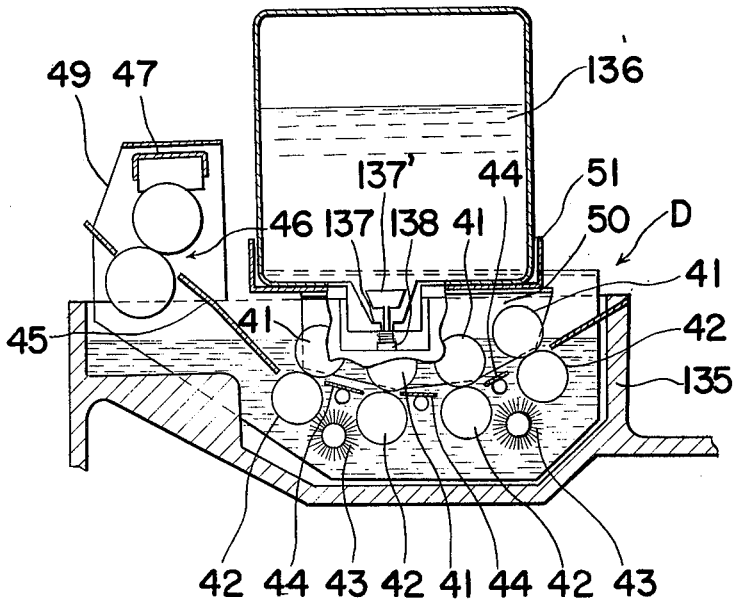

Referring to FIGS. 1 and 5, the transfer device T mainly comprises an electrically insulating roller 29 and a conductive roller 30 rotatably mounted in an arm plate 32, and a plurality of narrow belts 31 connecting the two rollers 29 and 30 for maintaining the adhesion of the copy paper sheet to the photoreceptor surface 3 of the drum 1. The above rollers 29 and 30, which are fixedly mounted on shafts 29' and 30', are rotatably supported by bearings 33 and 34 respectively mounted on upright opposite side walls **32*a* of the arm plate 32. Each of the bearings 33 and 34 is secured to a metal piece 32*b* slidably received in an elongated slot 32*c* formed in the side wall 32*a* of the arm plate 32 and is suitably urged upward by a spring 35 toward the photoreceptor drum 1 so that the rollers 29 and 30 contact the photoreceptor surface 3 under uniform pressure. The arm plate 32 is fixedly mounted on a shaft 37 which is rotatably supported on the frame 9 through bearings 36. An approximately L shaped lever 38 is secured, at the middle portion thereof, to the end of the shaft 37 extending through the frame 9 with one end of the lever 38 pivotally connected to a plunger 40 of the transfer solenoid $SL_2$. Accordingly, the movement of the plunger 40 of the solenoid $SL_2$ in the direction shown by the solid line arrow turns the arm plate 32, through the shaft 37 and the lever 38, toward the photoreceptor drum 1 (FIG. 1) with the rollers 29 and 30 contacting the photoreceptor surface 3. Upon de-energization of the soldnoid $SL_2$, the rollers 29 and 30 disengage from the photoreceptor 3 by their own weight and the weight of the arm plate 32 to return to their original position spaced away from the drum 1. The above operation of the arm plate 32 is effected, through the solenoid $SL_2$, by the signals generated by the transfer starting switch $SW_5$ (FIG. 12) and the transfer stopping switch $SW_9$ (FIG. 12) during the reciprocating movement of the platform 11**.

On the other hand, the transfer solenoid $SL_2$ is adapted to function only during the period in which the leading edge of the copy paper sheet has reached the transfer device T and the trailing edge thereof has passed through the transfer device T.

The above insulating roller 29 having an outer surface composed of an insulating material, for example, flexible rubber or sponge functions as to keep the copy paper sheet adhered to the photoreceptor surface 3 without any abnormal spark discharge between the photoreceptor surface 3 and the copy paper sheet during the period from the approach of the copy paper sheet to the photoreceptor surface 3 to the adhesion of the former to the latter, especially when the former is located close to the latter. The conductive roller 30 is composed of generally available conductive rubber or of insulating materials such as polyurethane coated or impregnated with an elastic conductive adhesive for electrical conduction, and is intended to effect the electrostatic transfer by electrically connecting the electrode at the back of the photoreceptor layer 3 with the conductive roller 30 contacting the reverse side of the copy paper sheet for effecting shortcircuiting therebetween and consequent grounding.

The surface potential of the electrostatic latent image formed on the photoreceptor surface 3 of the drum 1 is in the range of 800 to 1600 volts. Since the atmospheric discharge can normally be effected at a potential difference of approximate more than 600 volts when the gap between the latent image and the copy paper sheet is in the region from several tens to 100 $\mu$, a latent image corresponding to that on the photoreceptor surface 3 is formed on the copy paper sheet by shortcircuiting and grounding the conductive roller 30 and the electrode at the back of the photoreceptor layer 3, and allowing the copy paper sheet to pass between the conductive roller 30 and photoreceptor layer 3 with the gap as described above therebetween. However, instead of the short-circuiting and grounding in the above described manner, a bias voltage may be applied to the conductive roller 30 to adjust the above potential for coordinating the reproducibility of the transferred latent image with various conditions of exposure, development, and those depending upon the properties of the photoreceptor layer 3 and the copy paper sheet.

Moreover, the insulating roller 29 is not necessarily in contact with the photoreceptor surface 3, but may be spaced away from the latter during the transfer. In this case no inconvenience will be experienced for the close contact of the copy paper sheet if only the belts 31 are in contact with the photoreceptor surface 3. The transferred copy paper sheet with the latent image formed thereon is separated from the photoreceptor surface 3 against the electrostatic attraction to the latter partly due to the fact that the photoreceptor drum 1 is of a small diameter (approximately 60 mm) and partly because the resilience of the copy paper sheet itself works advantageously. Moreover, since the roll 16 of the copy paper is wound with its photosensitive surface onto which the latent image is to be transferred outward, the copy paper is always fed with its leading edge somewhat turned downward during transportation thereof due to curling of the copy paper while being wound on the roll 16, which curling works against the electrostatic attraction during separation of the copy paper from the photoreceptor surface 3 so as to facilitate the separation. In preparation for a situation where the separation may be insufficient because of the adoption of paricularly thin copy paper sheets with less resilience than in those commonly used, separating pieces 126 which are adapted to turn in synchronizaiton with the movement of the transfer device T are provided as in FIG. 5, in which there are shown a plurality of separating pieces 126 which are composed of materials with low friction coefficients such as Teflon and which are pivotally disposed at regular intervals on a shaft 129 rotatably supported at bearings 130 by the side walls of the frame 9 of the apparatus G. A ring 128 is fixedly mounted on the shaft 129 adjacent to each separating piece 126 with a torsion spring 127 disposed between the ring 128 and the separating piece 126. Since one end of the spring 127 is fixed to the ring 128 with the other end thereof secured to the separating piece 126, the pieces 126 can contact the photoreceptor surface 3 uniformly. On the other hand, a lever 131 in the form of a triangle is fixedly mounted, at the middle portion thereof, to the end of the shaft 129 extending through the frame 9, with a tension spring 132 stretched between one end of the lever 131 and a pin 132' secured on the frame 9, whereby the other end of the lever 131 is urged toward a contact pin 39 fixed to the end of the lever 38 remote from the plunger 40.

Accordingly, upon energization of the transfer solenoid $SL_2$ with the movement of the plunger 40 in the direction of the solid line arrow, the lever 38 is turned counterclockwise with the arm plate 32, which lever 38 simultaneously turns the lever 131 which in turn, causes the separating pieces 126 to rotate through the shaft 129 and the springs 127 with the separating pieces 126 contacting the photoreceptor surface 3 under proper pressure. When the transfer solenoid $SL_2$ is de-energized, the lever 38 turns clockwise together with plate 32 with the lever 131 and the shaft 129 for the separating pieces 126 also rotated clockwise, and consequently the separating pieces 126 leave the photoreceptor surface 3 and return to the original positions.

As described above, since the separating pieces 126 are adapted to pivot in synchronization with the rotation of the rollers 29 and 30, even a thin copy paper sheet is positively separated from the photoreceptor surface 3 and fed into the developing device D (FIG. 1) through a pair of static eliminating rollers 67 provided at the inlet of the developing device D so as to eliminate static at the reverse side of the copy paper sheet.

It should be noted here that the transfer device T described as employed in the copying apparatus of FIG. 1 can readily be replaced by an improved transfer device T' described later with reference to a second embodiment of the copying apparatus illustrated in FIG. 16.

Referring back to FIG. 1, after the transfer and separation of the copy paper sheet as described above, the electrostatic charge remaining on the photoreceptor surface 3 is removed by a static eliminating device, for example, by an erasing lamp 133 provided adjacent to the separating pieces 126. Subsequently any dust adhering to the photoreceptor surface 3 is wiped off therefrom by a dust removing cloth 134 which is adapted to lightly contact the photoreceptor surface 3.

It should also be noted here that, since the photoreceptor drum 1 employed in the apparatus of the invention has a small diameter of approximately 60 mm with the drum 1 adapted to rotate more than once per copying cycle, it is necessary for the whole outer periphery or part of the photoreceptor surface 3 of the drum 1 to be used twice for the latent image formation, transfer and subsequent erasing per every copying operation, except in a situation where the size of the image to be copied is particularly small, so that after an initial formation of a latent image, etc., has been completed, similar processes such as charging, exposure and transfer are repeated until scanning of the entire surface of the original to be copied is finished.

The copy sheet separated from the photoreceptor surface 3 is transported into the developing device D through the static eliminating rollers 67, in which case the surface potential of the electrostatic latent image formed by the transfer on the copy paper sheet is comparatively low, normally in the range from 60 to 150 volts, though the potential may differ depending on the conditions such as characteristics of the copy paper sheets and the photoreceptor 1, charging potential on the photoreceptor, and the presence of bias voltages during transfer, etc., so that a liquid developing means using electrode rollers are advantageously employed in the above case.

Figure 6:
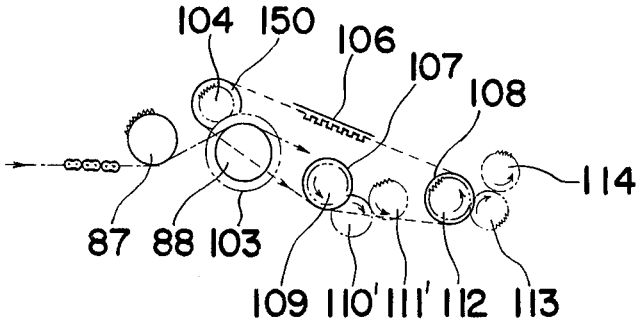
FIG. 6(a) is a schematic diagram showing a sectional side view, on an enlarged scale, of a developing device employed in the copying apparatus of FIG. 1.
FIG. 6(b) is a schematic diagram particularly showing a driving system of the developing device in FIG. 6(a)

Referring now to FIG. 6(*a*), the developing device D of the invention mainly comprises a first developing frame 49 in which there are provided four rotatable lower electrode rollers 42 of metallic material, three guide plates 44 for guiding the copy paper sheet, two cleaning brushes 43 rotatably in contact with the electrode rollers, a pair of squeezing rollers 46 for removing developing liquid from the copy paper sheet after developing, a guide plater 45 disposed between the last electrode roller 42 and the squeezing rollers 46, and a cleaner 47 disposed in contact with the upper roller of the rollers 46 for removing toner particles adhering to upper roller 46, and a second developing frame 50 provided on the first developing frame 49, in which frame 50 four upper electrode rollers 41 of metallic material and movable upwardly or downwardly are rotatably provided at positions corresponding to and in contact with the lower electrode rollers 42 of the first frame 49, with a receiving plate 51 for a developing solution supply tank 136 fixedly provided at the upper portion of the frame 50.

The above described first and second developing frames 49 and 50 are releasably received in a developing tank 135 formed integrally with a base plate B of the apparatus housing G (FIG. 1), and when the second frame 50 is mounted on the first frame 49, the upper electrode rollers 41 are adapted to engage the lower electrode rollers 42 under pressure due to the weight of the former.

The lower electrode rollers 42 are adapted to be driven by the driving force transmitted from the driving motor M (FIG. 1) with the upper rollers 41 rotating following the rotation of the lower rollers 42, and the copy paper sheet is transported while being held between the rollers 41 and 42. Each of the above upper electrode rollers 41 is electrically shortcircuited through the first and second developing frames 49 and 50.

Generally, the relation of the field strength in the vicinity of the electrostatic latent image to the distance between electrodes, for example, the distance between a latent image formed surface of a copy paper sheet and an electrode roller or a facing electrode such as an electrode plate is such that the field strength increases to a large extent as the distance between electrodes decreases, while it greatly decreases as the distance between electrodes increases. Accordingly, in a developing means employing electrode rollers, the developing position is limited to be located in the neighborhood of the developing rollers. In the developing device D of the present invention having a construction as described above, optimum developing efficiency due to the large increase of the field strength is achieved with sufficient density of the developed images by the adoption of a plurality of electrode rollers. The cleaning brushes 43 which are adapted to rotate in contact with the electrode rollers 42 are effective not only for preventing soiling at the reverse side of the copy paper sheet by removing developing toner adhering to the surfaces of the rollers 42, but for preventing the lowering of developing efficiency due to precipitation by uniform stirring of the developing solution, since the brushes 43 are rotating in the developing solution, stirring the latter.

The developing solution supply tank 136 releasably received in the receiving plate 51 fixedly mounted on the second developing frame 50 is provided with an opening 137 for supplying the developing solution at the lower portion thereof, which opening 137 has a stopper plug 137' which is normally urged to the inner edge of the opening 137 by a sprint 138 to close the opening 137 with the lower end of the plug 137' projecting from the opening 137.

Accordingly, when thetank 136 is placed in position on the receiving plate 51, the projecting end of the plug 137' and consequently the spring 138, is pressed back with the projecting end of the plug 137' contacting a part of the developing tank 135, and consequently developing solution flows from the supply tank 136 into the developing tank 135. When the level of the developing solution reaches the opening 137, air is prevented from entering the tank 136 and flow of the developing solution from the tank 136 stopped, and with the supplying of the same finished.

In the mean time, the copy paper sheet developed in the developing solution while passing between the electrode rollers 41 and 42 is transported through the guide plates 44 and 45 to the squeezing rollers 46 disposed immediately above the level of developing solution for removing unnecessary developing solution from the copy paper sheet, and subsequently fed into the drying and fixing device F (FIG. 1). Immediately before entering the drying and fixing device F, the copy paper sheet is again passed through rollers 48 (FIG. 1) of liquid absorbing material for further removing unnecessary developing solution.

It should be noted here that the developing device D of the wet developing type of FIG. 6(*a*) described as employed in the apparatus of FIG. 1 may be replaced by a developing device D' of the dry developing type which is described later with reference to FIG. 16.

Referring back to FIG. 1, the drying and fixing device F of the invention comprises an upper tubular heater $H_1$ and a lower tubular heater $H_2$, disposed along a path of the copy paper sheet for heating and fixing the developed image on the copy paper sheet from both sides thereof, reflecting shades 52 and 53 for the heaters $H_1$ and $H_2$ respectively, for reflecting heat rays therefrom, a fan 59 provided above the heater $H_1$ for directing air flow onto the heated copy paper sheet for drying, casings 54 and 55 surrounding the heaters $H_1$ and $H_2$ for insulating heat from the latter, guide plates 56 and 57 between which the copy paper sheet is to be transported, and a pair of rollers 58 for discharging the copied paper sheet out of the apparatus G.

Accordingly, the developed copy paper sheet with the unnecessary developing solution removed as it passes the liquid absorbing rollers 48 is subsequently passed between the guide plates 56 and 57, in which case the guide plates 56 and 57, especially the latter, are heated by the heat generated by the heater $H_2$, thus serving as a secondary heat generating plate which is effective for improving the fixing of toner by heating the developed copy paper sheet from its reverse side.

The developed copy paper sheet heated to a higher temperature while passing between the guide plates 56 and 57 is further blown by an air flow caused by the fan 59 for expediting evaporation of the developing solution, and the surface of the copy paper sheet is sufficiently dried, thereafter the copied paper sheet being discharged out of the apparatus G through the rollers 58.

Figure 7:
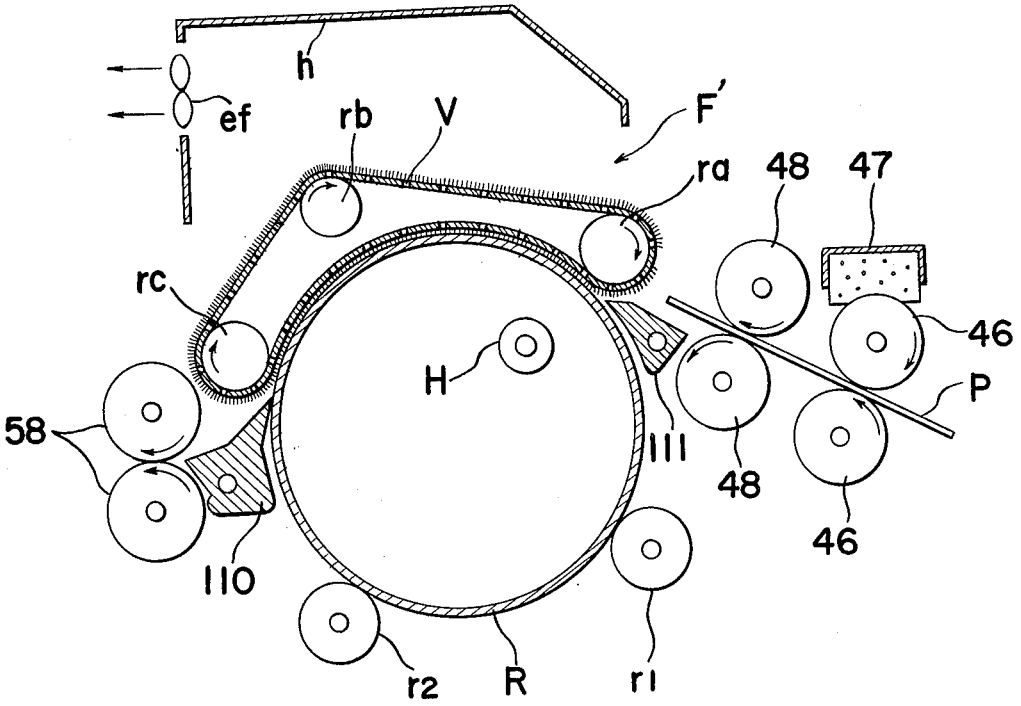
FIG. 7 is a schematic diagram showing a sectional side view, on an enlarged scale, of a modification of a drying and fixing device employed in the copying apparatus of FIG. 1.

Referring to FIG. 7, there is shown a first modification of the drying and fixing device F of the embodiment in FIG. 1. In this modification, the device F' comprises hollow cylinder R which is made of good heat transfer material, for example, of aluminum with either the inner periphery or both the inner and outer peripheries thereof treated with black anodized aluminum for better heat transfer. The cylinder R is supported for rotation by two rollers $r_1$ and $r_2$ rotatably provided below the cylinder R. A heater H of suitable type is enclosed in the cylinder R in a position close to an inlet for the wet copy paper sheet *p* adjacent the liquid absorbing rollers 48. Flat belt V comprising a sheet material having permeability to air as mentioned later is suspended, so as to be in close contact with the upper surface of the cylinder R, by three rollers $r_a$, $r_b$ and $r_c$ rotatably provided along the upper periphery of the cylinder R os that the belt V contacting the upper surface of the cylinder R is driven at same peripheral speed is the cylinder R drive to contact therewith.

It is needless to say that the belt V may be separately driven by a suitable independent driving means connected to one of the rollers $r_a$, $r_b$ and $r_c$.

The cylinder R should preferably be of air tight construction (not shown) so that the air inside the cylinder R is not affected by the external air for maintaining the cylinder R at an optimum temperature for fixing the copy paper sheet with a temperature detector (not shown) such as a thermistor or thermocouple incorporated therein.

In FIG. 7, the belt V is employed as a means for bringing the copy paper sheet *p* into close contact with the upper periphery of the cylinder R, and the wet copy paper sheet *p* subjected to development is adapted to pass between the cylinder R and the belt V along the surface of the cylinder R at the same peripheral speed as that of the latter.

A guide pawl 111 for guiding the wet copy paper *p* from the absorbing rollers 48 is provided adjacent to the surface of the cylinder R in a position between the roller $r_a$ for the belt V and the cylinder R close to the inlet for the copy paper sheet *p*.

Similarly, a separating pawl 110 for separating the copy paper sheet *p* transported between the belt V and the cylinder R, and directing the same toward the discharging rollers 58 is pivotally provided in contact with the surface of the cylinder R in a position between the roller $r_c$ for the belt V and the cylinder R and adjacent to the rollers 58 for discharging the fixed copy paper sheet out of the apparatus G.

The guide pawl 111 and the separating pawl 110 should preferably be made of material free from adhesion of toner, for example, fluoroplastics.

By this arrangement, the wet copy paper sheet *p*, the electrostatic latent image on which is visualized by the developing device D, is squeezed by the squeezing rollers 46 equipped with the cleaner 47 and fed between the belt V and the cylinder R after having passed through the absorbing rollers 48 for further absorbing the developing solution remaining in the copy paper sheet. The copy sheet thus fed onto the cylinder R is heated (at temperatures approximately 80° to 100° C) by the cylinder R as it is passed between the belt V and the cylinder R for drying and fixing, and subsequently delivered out of the apparatus G through the discharge rollers 58. A cover plate *h* and an exhaust fan $e_f$ are further provided above the belt V for driving the vapor and gas due to heating out of the apparatus G.

Figure 8:
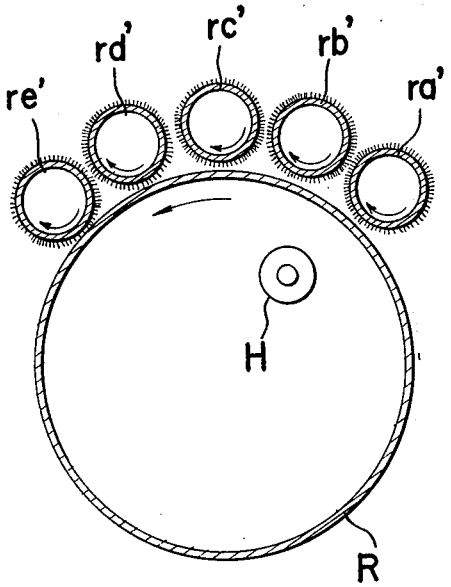
FIG. 8 is a schematic diagram showing a sectional side view, on an enlarged scale, of another modification of a drying and fixing device employed in the copying apparatus of FIG. 1.

Referring now to FIG. 8, there is shown a second modification F'' of the drying and fixing device of the embodiment in FIG. 1.

In this second modification, five rollers $r_a'$, $r'_b$, $r_c'$, $r_d'$, and $r_e'$ are rotatably provided with spaces therebetween along the upper surface of the cylinder R instead of the belt V and rollers $r_a$, $r_b$ and $r_c$ employed in the first modification of FIG. 7. The rollers $r_a'$ to $r_e'$ are each adapted to contact the surface of the cylinder R and are disposed to provide necessary contact area between the cylinder R and the wet copy paper sheet *p* to be dried and fixed, with the outer periphery of each of the rollers $r_a'$ to $r_e'$ covered by suitable sheet material having air permeability as mentioned below in a manner similar to the belt V in the first modification, so that sufficient permeability to vapor and gas due to heating is available between the rollers $r_a'$ to $r_3'$ and the copy paper sheet *p*.

Figure 9:
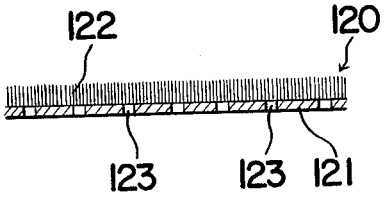
FIG. 9(a) is a cross sectional view, on an enlarged scale, of a part of an air permeable sheet material to be applied to the drying and fixing device of FIG. 7 or FIG. 8.
FIG. 9(b) is a view similar to FIG. 9(a), but shows a modification thereof.
FIG. 9(c) is a view similar to FIG. 9(a), but shows another modification thereof.
Figure 9:
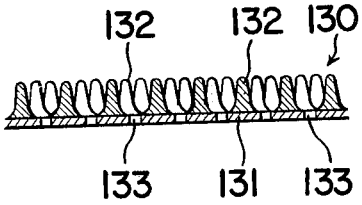
Figure 9:
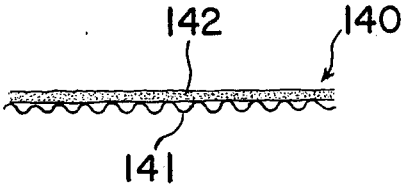

Referring to FIGS. 9(*a*), (*b*), and (*c*), there are shown modifications of the air permeable sheet materials to be applied to the drying and fixing devices of the above first and second modifications in FIGS. 7 and 8, respectively.

The sheet material 120 shown in FIG. 9(*a*) is equivalent to one employed in the belt V in FIG. 7 and comprises a flexible base 121 of any suitable material, such as leather, synthetic resin sheet material, woven fabric, rubber sheet material, metal sheet material and wire mesh etc., and brush bristles 122 of any heat and abrasion resistant material such as synthetic fiber, natural fiber of cotton or animal fur which are suitably secured on the entire upper surface of the base 121 with many ventilation holes 123 formed in the base 121 if the latter lacks air permeability.

The above brush bristles 122 render the surface of the sheet material 120 a non-smooth contact surface with the tips of the brush bristles 122 contacting corresponding points on the entire surface of the wet copy paper sheet *p*, thereby forming small spaces for ventilation which allow the vapor to flow between the sheet material 120 and the copy paper sheet *p*, and consequently the vapor is dissipated through the ventilation holes 123 formed in the base 120.

If the sheet material 120 as described above is applied on the surface of the rollers $r_a'$ to $r_e'$ in the second modification of the drying and fixing device F'' in FIG. 8, the ventilation holes 123 employed in FIG. 9(*a*) need not necessarily be formed, since the contact surface between the rollers $r_a'$ to $r_e'$ and the wet copy paper sheet *p* is small and the vapor and gases generated by heat are exhausted upward through the spaces between the neighboring rollers $r_a'$ to $r_e'$.

In the sheet material 130 shown in FIG. 9(*b*), many wart-like protrusions 132 of flexible materials such as rubber and synthetic resin are formed on base 131 with the spaces between the neighboring protrusions 132 adapted to be sufficient to store and flow the vapor from the wet copy paper. Similarly to the sheet material 120 described in FIG. 9(*a*), many ventilation holes 133 should be formed if the sheet material 130 is applied to the belt V in FIG. 7, which holes 133 need not necessarily be formed in the base 131 if the sheet material 130 is to be used for the rollers $r_a'$ to $r_e'$ in FIG. 8 or if the base 131 is made of air permeable material.

The sheet material 140 shown in FIG. 9(*c*) comprises a base 141 of woven fabrics or mesh cloth having a felt layer 142 formed on the upper surface thereof.

It should be noted that the above described sheet material can further be modified to suit the purpose. For example, the felt layer 142 or he brush bristles 122 as described above may be directly formed on the rollers $r_a'$ to $r_e'$ of the device F in FIG. 7, or a single sheet of a nonwoven fabric can be used for a sheet material instead of the construction of the base 141 and felt layer 142 described in FIG. 9(*c*).

According to the experiments carried out by the present inventors, the above described brush bristles 122 in FIG. 9(*a*), the wart-like protrusions 132 in FIG. 9(*b*) and the felt layer 142 in FIG. 9(*c*) for forming the upper surfaces of the sheet materials 120, 130 and 140 into non-smooth contact surfaces so as to provide small spaces for ventilation between the belt V or the rollers $r_a'$ to $r_e'$ and the wet copy paper sheet *p* should be composed of flexible materials. If any hard materials are employed, it is impossible to avoid the so-called offset effect when such hard materials contact the surface of the copy paper sheet. On the other hand, if the non-smooth contact surfaces are formed of flexible materials as described above, such flexible materials need not be such as tetrafluorethylene which are free from the adhesion of toner, and the offset effect can be eliminated to such an extent that no inconvenience is practically experienced in actual use even when the flexible materials are of natural fibers to which the toner tends to adhere.

Furthermore, the treatment of the inner or both the inner and outer peripheries of the cylinder R with black anodized aluminum is effective for absorbing the heat from the heater H into the cylinder R with consequent increase of thermal efficiency for heating the wet copy paper sheet to a large extent.

Likewise, by providing the heater H in positions as shown in FIGS. 7 and 8 with and the thickness of the hollow cylinder R less than 2 mm, the time required for the device to be ready for operation can be advantageously reduced for efficient heating of the copy paper sheet *p*, which arrangement does not not limit the position of the heater H or the number of the heaters involved, but can be modified to suit the purpose of the invention in various ways.

It is another advantage of the drying and fixing device described above that, since the surface of the belt V or the rollers $r_a'$ to $r_e'$ for allowing the copy paper sheet to closely contact the surface of the cylinder R is formed into the non-smooth contact surface which contacts the entire surface of the copy paper sheet *p* in the form of many points with spaces formed between the belt or the rollers and the copy paper sheet, no uneven heating of the copy paper sheet is caused, thus remarkably increasing the drying and fixing efficiency with uniform heating over the entire surface of the copy paper sheet, and without any spoiling of the copied images due to the offset effect. Consequently, the cost for copying can be reduced to a large extent.

Figure 10:
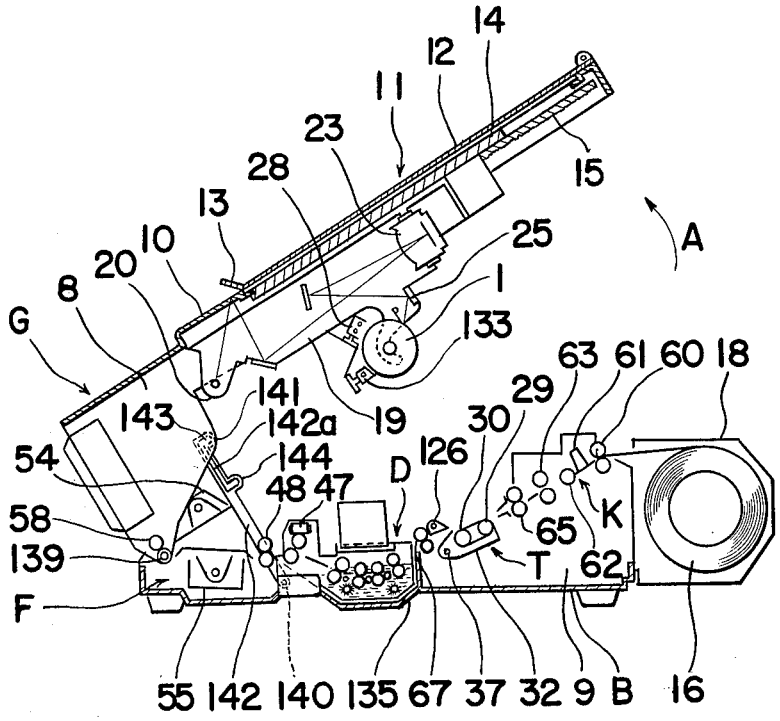
FIG. 10 is a view similar to FIG. 1, but particularly shows the construction of the housing of the copying apparatus with an upper frame thereof in its raised position.

Referring now to FIG. 10, the apparatus housing G of the invention is divided into two portions, i.e., an upper frame 8 and a lower frame 9 with the upper frame 8 pivotally connected to the lower frame 9 by the same shaft 139 as for the lower discharging roller 58 rotatably mounted on the lower frame 9. The pivotal connection permits the upper frame 8 to be raised about the shaft 139 in the direction shown by an arrow A or lowered to combine the frames 8 and 9 into one housing G. For supporting the upper frame 8 in the raised or lowered position, there are provided a stopper pin 141 secured to the side wall of the upper frame 8 and a lever 142 pivotally connected at the lower end thereof to the lower frame 9 by a pin 140. The lever 142 is provided at the upper portion thereof with an elongated U-shaped groove 142*a* in which the pin 140 is slidably received. The groove 142 is further provided with upper and lower bent portions 143 and 144 which work as stoppers for supporting the pin 140. Accordingly, when the pin 140 is slid into the upper bent portion 143 of the groove 142*a*, the upper frame 8 is kept at its raised position, and the frame 8 is locked at its closed position, combined with the lower frame 9 when the pin 141 is slid into the lower bent portion 144 of the groove 142*a*. The platform 11, the optical frame 19, the photoreceptor drum 1, the corona charger 28, an erasing lamp 133 and the upper casing 54 including the heater $H_1$ for the drying and fixing device, are mounted on the upper frame 8, while the releasable casing 18 including the roll 16 of copy paper, rollers 60, the paper web cutting device *k* including the stationary blade 61 and rotatory blade 62, the rollers 63 and 65, the transfer device T, the separating piece 126, rollers 67, the developing device D received in the developing tank 135, rollers 48, the lower casing 55 including the heater $H_2$ for the drying and fixing device F, and rollers 58 etc., are disposed on the lower frame 9 along the path of the copy paper sheet.

Although in FIG. 10, the drum 1 is shown as mounted on the upper frame 8, it is preferable from the viewpoint of simplification of the driving engagement that the drum 1 be included on the side of the lower frame 9.

Figure 11:
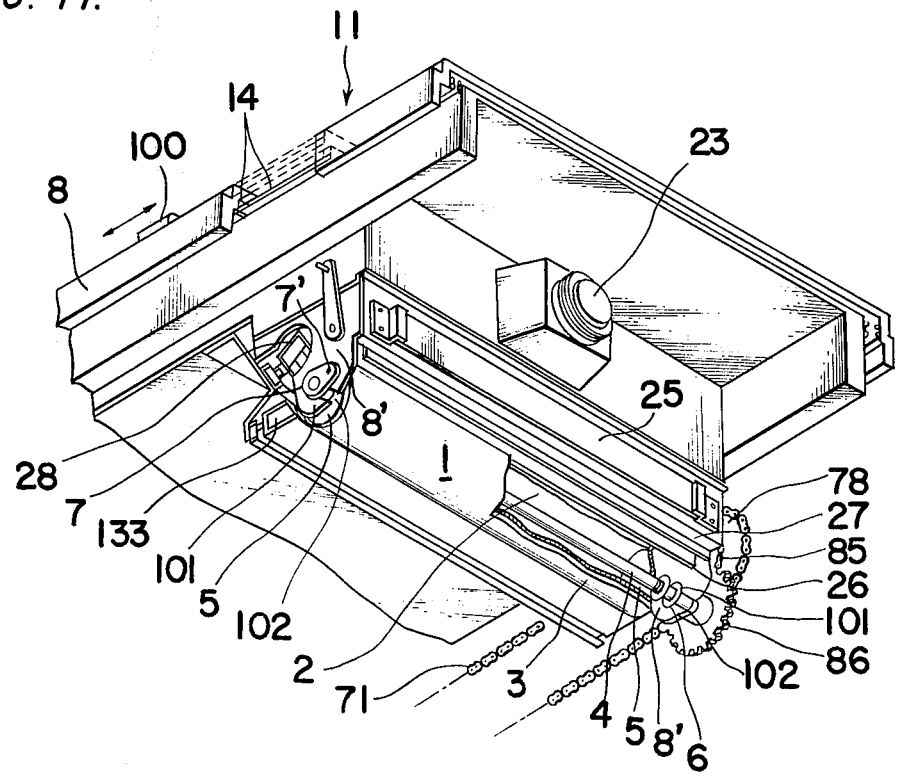
FIG. 11 is a perspective view, on an enlarged scale, of a photoreceptor drum and associated mechanisms therewith employed in the copying apparatus of FIG. 1.

Referring to FIG. 11, the photoreceptor drum 1 rotatably mounted on the upper frame 8 comprises a cylindrical drum 2 of electroconductive material, for example, aluminum, a pair of disks 5 forming side walls of the drum 2 and a shaft 4 on which the drum 2 is fixedly mounted.

A thin layer of amorphous selenium approximately less than 1 $\mu$ in thickness is deposited on the outer periphery of the drum 2, which layer is further coated with an electrophotosensitive layer of polyvinyl carbazole approximately 20 $\mu$ in thickness to form a composite photoreceptor surface 3. It is needless to say that conventional photoreceptors of non-crystalline selenium, cadmium sulfide or zinc oxide may be used instead of the above composite photoreceptor 3.

A gear 86 for driving the photoreceptor drum 1 is fixedly provided on one end of the shaft 4 for transmitting the driving force to the drum 1 to rotate the same in the clockwise direction in FIG. 1 during operation thereof. The photoreceptor drum 1 is adapted to be replaced in the manner described below.

The shaft 4 for the drum 1 is supported at ends thereof by a pair of bearings 6 fitted in openings 101 with notched portions 102, which openings 101 are formed on the opposite depending sides 8' of the upper frame 8 with the bearings 6 prevented from axial movement thereof by a pair of bearing cases 7 releasably attached to the outer surfaces of the depending sides 8' of the upper frame 8 by securing screws 7'. When replacing the drum 1, the bearing cases 7 are removed by loosening the screws 7', the shaft 4 is axially moved to detach the bearings 6 from the openings 101, and subsequently the shaft 4 can be drawn out through the notches 102 for removal of the drum 1.

Figure 2:
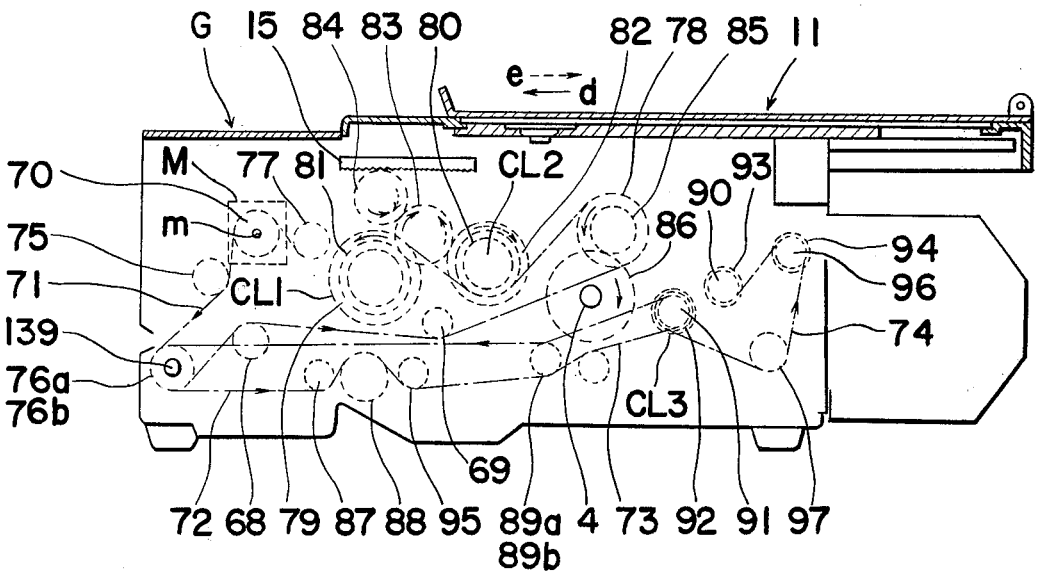
FIG. 2 is a similar view to FIG. 1, but particularly shows driving systems thereof.

Referring now to FIG. 2, driving systems of the copying apparatus of the invention are described hereinbelow.

The driving system mainly comprises a platform driving system, a developing device driving system and a copy paper sheet feed driving system which are disposed in the upper and lower frames 8 and 9 of the apparatus G.

In the platform driving system, a sprocket 70 is fixedly mounted on a driving shaft m of the motor M and the driving force of the motor M is transmitted from the sprocket 70, through a chain 71 for moving the platform 11, to an idle sprocket 75, a discharge roller sprocket 76*a*, idle sprockets 68 and 69, a photoreceptor drum sprocket 78, a platform returning clutch sprocket 80, a platform advancing clutch sprocket 79, and an idle sprocket 77, each of which being rotatably mounted on the frame of the apparatus G. The advancing clutch sprocket 79 mentioned above is further provided with an advancing clutch gear 81 through a clutch $CL_1$ for advancing the platform 11, while a returning clutch gear 82 is attached to the returning clutch sprocket 80 through a clutch $CL_2$ for returning the platform 11. The rotations of the above advancing clutch gear 81 and the returning clutch gear 82 are transmitted to the rack 15 secured to the movable frame 10 (FIG. 1) of the platform 11 through an idle gear 83 and a pinion 84 for reciprocating the platform 11. In FIGS. 1 and 2, the advancing of the platform 11 is shown by an arrow *d* and the returning thereof is denoted by an arrow *e*.

A photoreceptor drum driving gear 85 is fixedly mounted on the same rotatable shaft as the photoreceptor sprocket 78, which gear 85 is adapted to mesh with the photoreceptor gear 86 which is fixedly mounted on the shaft 4 of the photoreceptor drum 1 for the rotation of the drum 1.

In the developing device driving system, the shaft 139 for the lower discharge roller 58, which shaft 139 is also used for pivotal connection for the upper frame 8 to the lower frame 9 of the apparatus G (FIG. 10), is further provided with two discharge roller sprockets 76*a* and 76*b* fixedly mounted thereon, one of which sprockets 76*a* is connected to the chain 71 for reciprocating the platform 11 as described earlier, while the other sprocket 76*b* is connected to a developing device driving chain 72 which is directed over a liquid absorbing roller sprocket 87, a developing device driving sprocket 88, an idle sprocket 95 and a static eliminating roller sprocket 89 for transmitting driving force to the latter.

Accordingly, the discharge roller sprocket 76*a*, the liquid absorbing roller sprocket 87 and the developing device driving sprocket 88 drive the discharge roller 58, the liquid absorbing roller 48 and the developing device D (FIG. 1), respectively.

Referring to FIG. 6(*b*), a developing device driving gear 103 which is fixed on the same shaft as the developing device driving sprocket 88 drives the squeezing rollers 46 (FIG. 1) through a squeezing roller gear 104 and also drives a timing gear 150 mounted on the same shaft as the squeezing roller gear 104. A timing belt 106 is directed over the timing gear 150, a timing gear 107 and a timing gear 108 to drive the gears 107 and 108. Since an electrode roller gear 109 fixed on the same shaft as the timing gear 107 meshes with a cleaning brush gear 110' which in turn engages an electrode roller gear 111' while an electrode gear 112 secured on the same shaft as the timing gear 108 meshes with a cleaning brush gear 113 which in turn engages an electrode roller gear 114, the driving force is transmitted to the electrode rollers 42 and the cleaning brushes 43 (FIG. 6(*a*)) respectively.

Referring back to FIG. 2, in the copy paper sheet feed driving system, two static eliminating roller sprockets 89*a* and 89*b* are mounted on the shaft for one of the static eliminating rollers 67 (FIG. 1), one of which sprockets 89*a* is connected to the developing device driving chain 72 mentioned earlier, while the other sprocket 89*b* is connected to a copy paper sheet feed driving chain 73 which is directed over a copy paper sheet feed clutch sprocket 91 for driving the same. A copy paper sheet feed clutch $CL_3$ and a copy paper sheet feed clutch sprocket 92 are mounted on the same shaft as the sprocket 91, through which clutch $CL_3$ the driving force is transmitted to the sprocket 92. It is to be noted that the sprocket 91 mentioned above is fixedly mounted on the same shaft as one of the rollers 65 (FIG. 1) for simultaneous rotation therewith during the operation of the latter. A copy paper sheet feed chain 74 is directed over the above copy sheet feed clutch sprocket 92, an idle gear 97, a first roller sprocket 96 and a loop forming roller sprocket 90 for transmitting the driving force to the gear 97, and the sprockets 96 and 90. Mechanical one-way clutches 93 and 94 are mounted on the same shafts as the sprockets 90 and 96 respectively, through which clutches 93 and 94 the driving force is transmitted to the loop forming roller 63 and the first roller 60 (FIG. 1). It should be noted here that the one-way clutch 94 is adapted to function in such a manner that the first rollers 60 rotate following the rotation of the loop forming roller 63 through the copy paper sheet, while the one-way clutch 93 functions so that the loop forming rollers 63 or the first rollers 60 rotate following the rotation of the second rollers 65 through the copy paper sheet as described earlier.

Figure 12:
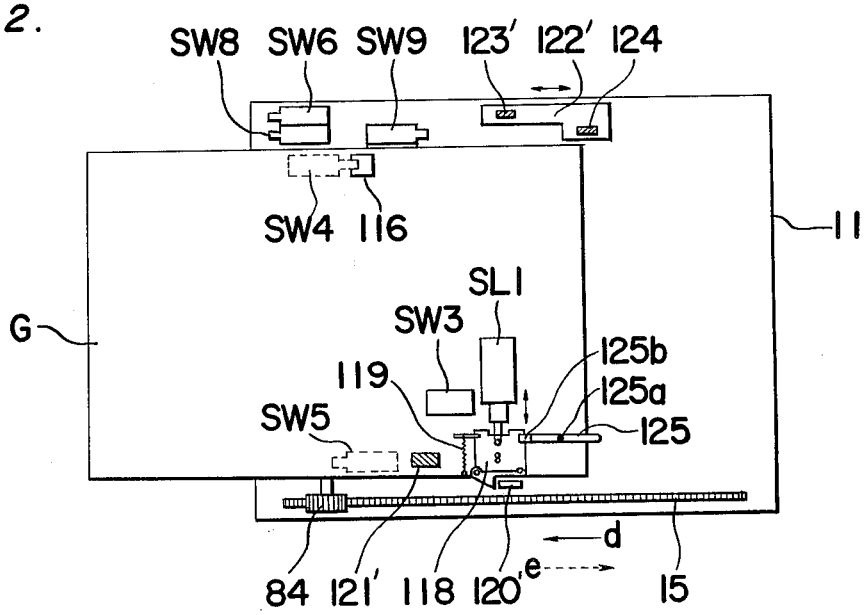
FIG. 12 is a schematic diagram particularly showing positions of various switches and corresponding actuating projections as observed from the lower side of the apparatus in FIG. 1.

Referring now to FIG. 12, positions of switches for the control of the copying apparatus of the invention associated with the reciprocation of the platform 11 as observed from the underside of the upper frame 8 of the apparatus housing G are described hereinbelow.

Microswitches to be actuated by the reciprocation of the platform 11, such as a platform advancing switch $SW_3$, a platform returning stopping switch $SW_4$, a transfer starting switch $SW_5$, a copy paper cut switch $SW_6$, a platform returning switch $SW_8$ and a transfer stopping switch $SW_9$ are mounted on the housing side of the apparatus G, while corresponding projections 120', 116, 121', 123' and 124 for actuating the above microswitches $SW_3$, $SW_4$, $SW_5$, $SW_6$, $SW_8$ and $SW_9$ are fixed on the platform side 11.

In FIG. 12, the platform 11 is in the starting position for copying operation, in which state the platform returning stopping switch $SW_4$ is depressed by the projection 116.

The projecting plate 122' slidably mounted at one side of the platform 11 is set at a predetermined position corresponding to the required length of the original to be copied in association with a random cutting knob 100 (FIG. 11) provided on one side edge of the platform 11 for cutting the web of copy paper into a length corresponding to that of the original.

Upon starting of the copying operation, when the copy paper sheet actuates the switch $SW_2$ for releasing the locking of the platform 11 (FIG. 1), the solenoid $SL_1$ for releasing the locking of the platform 11 is energized. Since the solenoid $SL_1$ is connected to a slidable locking plate 118 which is urged to a locking projection 120' fixed to the platform 11 by a spring 119 for stopping the platform 11, the energization of the solenoid $SL_1$ pulls the plate 118 away from the projection 120' against the force of the spring 119 with the plate 118 disengaged from the projection 120'. Simultaneously, the one edge of the plate 118 thus pulled is adapted to depress and actuate the switch $SW_3$ for advancing the platform 11, the signal from which switch $SW_3$ in turn operates the clutch $CL_1$ for advancing the platform 11 (FIG. 2) with the platform 11 starting to move in the advancing direction indicated by the arrow d in FIG. 1.

When the switch $SW_5$ for starting the transfer is first depressed by the projection 121' as the platform 11 advances, the solenoid $SL_2$ (FIG. 5) for transfer is actuated with the rollers 29 and 30 for the transfer device T (FIG. 1) contacting the photoreceptor drum 1.

Subsequently, when the projection 123' on the projecting plate 122' depresses the paper cut switch $SW_6$ as the platform 11 advances, the cutter solenoid $SL_3$ (FIG. 1) is energized to rotate the rotatory blade 62 for cutting the web of copy paper as described earlier. When the projection 124 fixed on the plate 122' depresses the switch $SW_8$ for returning the platform 11 after passing over the switch $SW_9$ for stopping the transfer, the clutch $CL_1$ (FIG. 2) for advancing the platform 11 stops functioning with the clutch $CL_2$ (FIG. 2) for returning the platform 11 operated for the platform 11 to start returning movement.

During the returning movement of the platform 11, the depression of the switch $SW_9$ by the projection 124 causes the transfer solenoid $SL_2$ to be de-energized with the rollers 29 and 30 of the transfer device T leaving the photoreceptor drum 1.

Consequently, the platform 11 returns to the original starting position, in which case the projection 116 depresses the switch $SW_4$ for stopping returning of the platform 11, the signal from which switch $SW_4$ de-energizes the clutch $CL_2$ for returning the platform 11.

In the above state, the platform 11 remains stationary until the next copying is started.

A lever 125 for releasing the locking of the platform 11 is to be used when it is necessary to manually release the locking of the platform 11, and is rotatably attached at the middle portion thereof by a pin 125*a* to the housing G at a position adjacent to the locking plate 118 with one end 125*b* of the lever 125 pivotally connected to one corner of the plate 118. Upon turning the free end of the lever 125 about the pin 125*a*, the locking plate 118 is moved to leave the projection 125, enabling the platform 11 to be freely moved manually in the advancing direction thereof.

Figure 13:
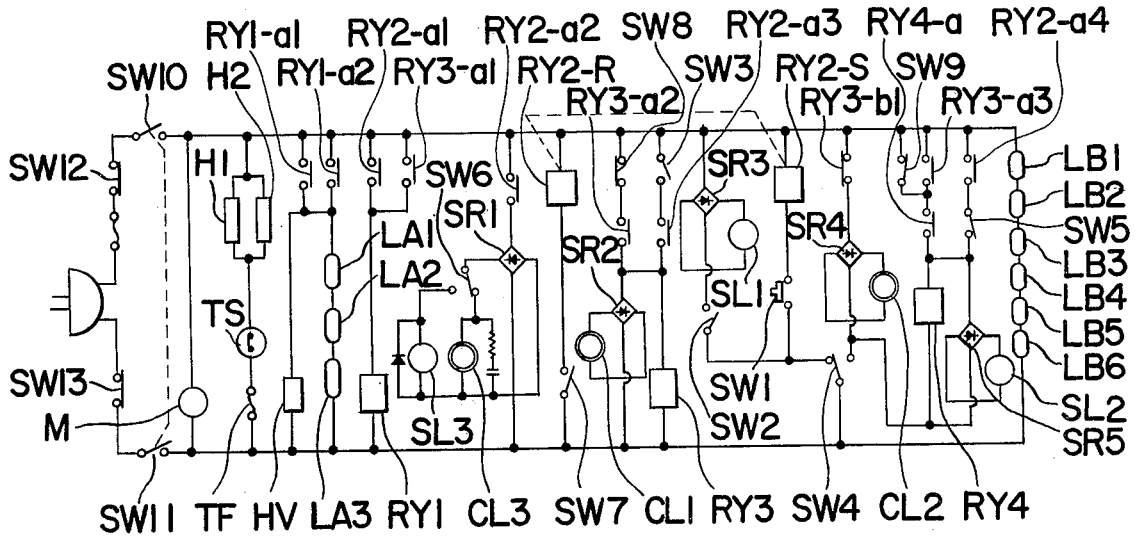
FIG. 13 is an electrical circuit diagram illustrating various elements of the copying apparatus according to the present invention.
Figure 14:
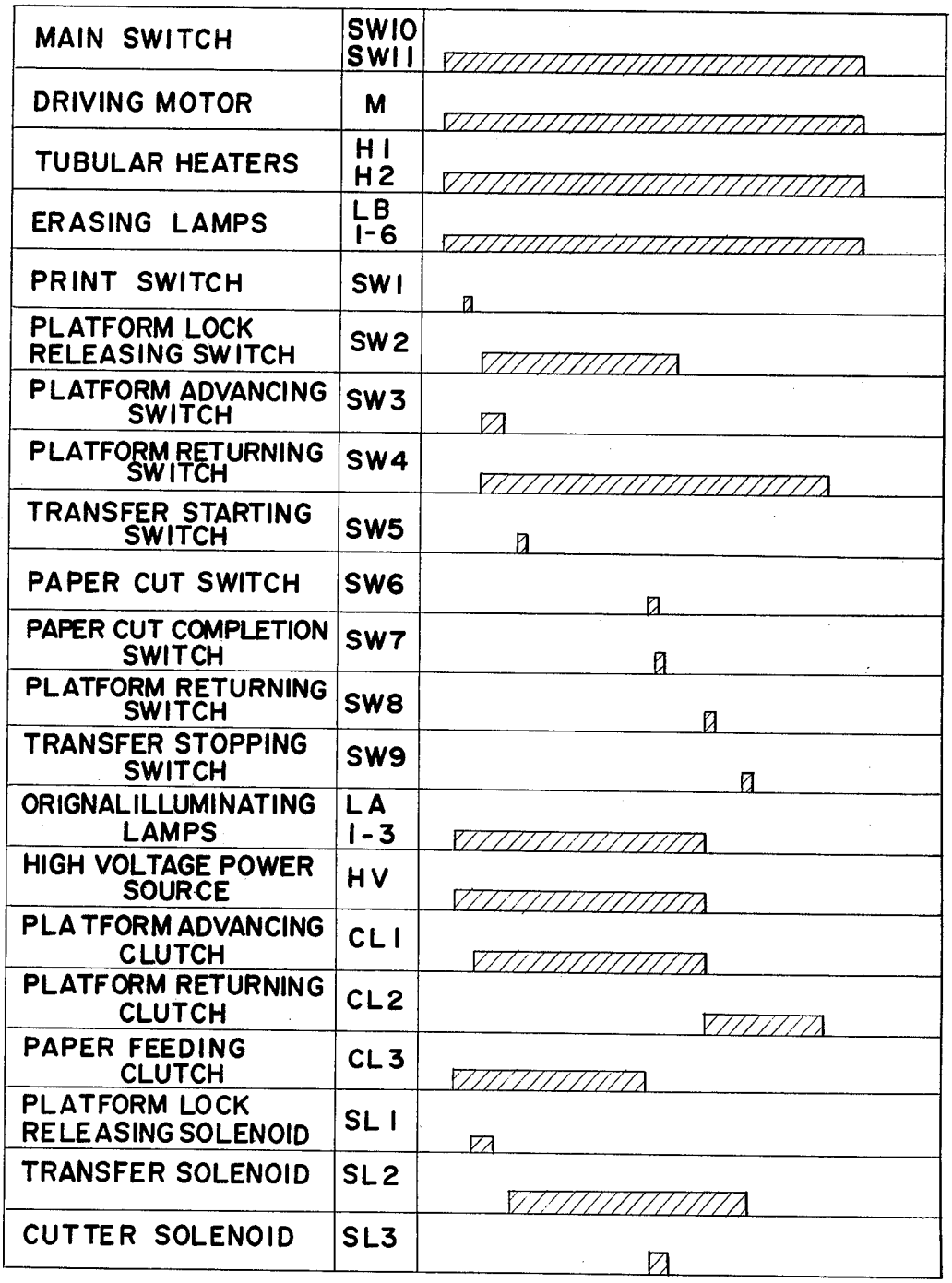
FIG. 14 is a timing chart showing the sequence of operation for the copying apparatus of the present invention.

Referring to FIGS. 13 and 14, the control mechanism of the copying apparatus of the invention is described hereinbelow.

In FIG. 13, there is shown an A.C. circuit comprising main switches $SW_{10}$ and $SW_{11}$, the driving motor M, the tubular heaters $H_1$ and $H_2$ for drying and fixing, a thermal fuse TF for protecting the drying and fixing device, a thermostat TS for temperature control, a high voltage power source HV, lamps $LA_1$, $LA_2$ and $LA_3$ constituting the light source 20 (FIG. 1) for illumination, a lamp relay $RY_1$, the cutter solenoid $SL_3$, the copy paper feeding clutch $CL_3$, the paper cutting switch $SW_6$ also used for providing instruciton to stop feeding of copy sheets, rectifiers $SR_1$ to $SR_5$, latching relays $RY_2$-R and $RY_2$-S, a switch $SW_7$ for completion of copy paper cutting, the clutch $CL_1$ for advancing the platform 11, a relay $RY_3$, the switch $SW_2$ for releasing the locking of the platform 11, the switch $SW_8$ for reciprocating the platform 11, the solenoid $SL_1$ for releasing the locking of the platform 11, the switch $SW_3$ for advancing the platform 11, a print switch $SW_1$, the clutch $CL_2$ for returning the platform 11, the switch $SW_4$ for stopping the returning of the platform 11, a relay $RY_4$, the transfer solenoid $SL_2$, the switch $SW_5$ for starting the transfer, the switch $SW_9$ for stopping the transfer, and lamps $LB_1$ to $LB_6$ constituting the erasing lamp 133 (FIG. 1), all of which are connected to one another to form such A.C. circuit.

The normally open main switches $SW_{10}$ and $SW_{11}$ are each connected in series with a normally closed safety switch $SW_{12}$ or $SW_{13}$ provided at the front door of the apparatus G or other suitable portions of the apparatus G which can be opened or closed.

When the above main switches $SW_{10}$ and $SW_{11}$ are closed upon depression, the driving motor M, the tubular heaters $H_1$ and $H_2$ for drying and fixing, and lamps $LB_1$ to $LB_6$ are energized, and the driving systems, including the copy paper transportation mechanisms except for the first rollers 60 and loop forming rollers 63 (FIG. 1), which are associated with starting of paper feeding, and the photoreceptor drum 1 are driven by the rotation of the driving motor M and continue to rotate while the main switches $SW_{10}$ and $SW_{11}$ are closed.

Since the thermostat TS, which control the temperature and which is mounted on the drying and fixing device F controls the supply of current to the heaters $H_1$ and $H_2$, the temperature in the drying and fixing device F is kept at a constant level. The lamps $LB_1$ to $LB_6$ constituting the erasing lamp 133 (FIG. 1) are adapted to be "on" while the main switches $SW_{10}$ and $SW_{11}$ are closed for erasing the electrostatic charge on the surface of the photoreceptor drum 1. After the above described preparation for the copying operation, the printing switch $SW_1$ is closed upon depression of a print button (not shown). On the other hand, since the platform 11 is in its starting position, the switch $SW_4$ for stopping the returning of the platform 11 is actuated with the movable contact thereof closed to the side of the printing switch $SW_1$ and accordingly, the latching relay $RY_2$-S (set coil) is energized upon closure of the printing switch $SW_1$ with the contacts $RY_2$-$a_1$, $RY_2$-$a_2$, $RY_2$-$a_3$, and $RY_2$-$a_4$ of the relay $RY_2$-S closed. Upon closure of the contact $RY_2$-$a_1$, the lamp relay $RY_1$ is energized and the lamps $LA_1$, $LA_2$, and $LA_3$ for illuminating the original are lit through the contacts $RY_1$-$a_1$ and $RY_1$-$a_2$ of the relay $RY_1$ with the high voltage power source HV connected in parallel to the lamps $LA_1$ to $LA_3$ functioning simultaneously. When the contact $RY_2$-$a_2$ of the relay $RY_2$-S is closed, the rectifier $SR_1$ is energized with the paper feeding clutch $CL_{32}$ (FIG. 2) actuated through the paper cutting switch $SW_6$, this last switch is normally closed to the side of the clutch $Cl_3$ except when the web of paper is to be cut, and this causes the first rollers 60 and loop forming rollers 63 (FIG. 1) to rotate to feed the copy paper sheet to the photoreceptor drum 1.

When the leading edge of the copy paper sheet reaches the switch $SW_2$ for releasing the locking of the platform 11 as the copy paper sheet advances, the switch $SW_2$ is closed to actuate the solenoid $SL_1$ for releasing the locking of the platform 11. Upon actuation of the solenoid $SL_1$, the plate 118 (FIG. 12) for locking the platform 11 is moved to actuate the switch $SW_3$ (FIG. 12) for advancing the platform 11 as described earlier, and the relay $RY_3$ is energized through the contact $RY_2$-$a_3$ closed by the actuation of the latching relay $RY_2$.

The energization of the relay $RY_3$ causes the contacts $RY_3$-$a_1$, $RY_3$-$a_2$ and $RY_3$-$a_3$ thereof to be closed with the contact $RY_3$-$b_1$ opened. The relay $RY_3$ is kept energized and self-retained by the closure of the contact $RY_3$-$a_2$ thereof through the normally closed switch $SW_8$ for returning the platform 11.

Simultaneously, the clutch $CL_1$ for advancing the platform 11, which is connected in parallel with the relay $RY_3$, is actuated for transmission of the driving force from the driving system to the platform 11, and the platform 11 starts advancing.

As the platform 11 starts advancing, the switch $SW_4$ for stopping the returning of the platform 11 which is depressed by the projection 116 (FIG. 12), is released from its depressed condition with the moving contact of the switch $SW_4$ switched from the side of the switch $SW_2$ for releasing the locking of the platform 11 over to the side of the clutch $CL_2$ for returning the platform 11. The solenoid $SL_1$ for releasing the locking of the platform 11 is thus de-energized with the locking plate 118 (FIG. 12) returning to the original locking position. It should be noted, however, that the platform 11 is actually locked only when it has returned to its original starting position.

Although the switch $SW_2$ for releasing the locking of the platform 11 is adapted to open its contact when the above locking plate 118 for the platform 11 has returned to its original position, the relay $RY_3$ and the clutch $CL_1$ for advancing the platform 11 continue to be operated since the relay $RY_3$ is self-retained by the closure of the above contact $RY_3$-$a_2$ thereof.

As the platform 11 advances further, the switch $SW_5$ for starting the transfer is depressed with the contact thereof closed, and the relay $RY_4$ is energized through the contact $RY_2$-$a_4$ which is closed by the action of the latching relay-$RY_2$. Simultaneously the transfer solenoid $SL_2$connected in parallel to the relay $RY_4$ through the rectifier $SR_5$ is energized.

Upon energization of the relay $RY_4$, the contact $RY_4$-$a$ thereof is closed and the relay $RY_4$ is self-retained to be kept energized through the contact $RY_3$-$a_3$ which is closed by the action of the relay $RY_3$ with the transfer solenoid $SL_2$ kept functioning.

A further advancement of the platform 11 actuates the paper cutting switch $SW_6$ with the movable contact thereof switched over to the side of the paper feed clutch $CL_3$. Accordingly, the clutch $CL_3$ stops functioning with the rotation of the first rollers 60 and loop forming rollers 63 stopped, and simultaneously the cutter solenoid $SL_3$ is energized to operate the cutting device *k* (FIG. 1) including the stationary blade 61 and the rotatory blade 62 for cutting the web of copy paper. In this case the switch $SW_7$ for confirming the completion of normal operation of the rotatory blade 61 is actuated with the contact thereof closed.

Upon closure of the contact of the switch $SW_7$, the latching relay $RY_2$-R (re-set coil) is energized, and through the consequent actuation of the latching relay $RY_2$-S (set coil), each of the closed contacts $RY_2$-$a_1$, $RY_2$-$a_2$, $RY_2$-$a_3$ and $RY_2$-$a_4$ is opened back into the original condition.

A further advancing of the platform 11 actuates the switch $SW_8$ for returning the platform 11 to open the contact thereof, whereby the self-retained relay $RY_3$ and the clutch $CL_1$ for advancing the platform 11 are de-energized.

Accordingly, the self-retaining of the relay $RY_3$ is released for the relay $RY_3$ to stop functioning, and consequent closure of the contact $RY_3$-$b_1$ of the relay $RY_3$ actuates the clutch $CL_2$ for returning the platform 11 through the actuation of the switch $SW_4$ for stopping the returning of the platform 11, and the platform 11 starts returning.

Simultaneously, the contacts $RY_3$-$a_1$, $RY_3$-$a_2$ and $RY_3$-$a_3$ are opened, and the opening of the contact $RY_3$-$a_1$ de-energized the lamp relay $RY_1$ with the contacts $RY_1$-$a_1$ and $RY_1$-$a_2$ thereof opened, whereby the lamps $LA_1$, $LA_2$ and $LA_3$, constituting the light source 20 for illuminating the original to be copied, are turned off and the high voltage power source HV is also de-energized.

With the returning of the platform 11, the switch $SW_9$ for stopping the transfer is actuated with the contact thereof opened.

In the above state, the contact $RY_3$-$a_3$ connected in parallel with the above switch $SW_9$ has already been opened, and the relay $RY_4$ and the transfer solenoid $SL_2$ are energized through the switch $SW_9$ for stopping transfer. The opening of the contact of the switch $SW_9$ as described above releases the relay $RY_4$, with both the relay $RY_4$ and the transfer solenoid $SL_2$ ceasing to function. When the platform 11 has further returned back to the original starting position, the switch $SW_4$ for stopping the returning of the platform 11 is actuated to de-energize the clutch $CL_2$ for returning the platform 11, with the platform 11 remaining stationary at the original starting position thereof.

In the case of continuous copying, the printing switch $SW_1$ is kept closed, and by the energization of the latching relay $RY_2$-S through the switch $SW_4$ for stopping the returning of the platform 11 every time the platform 11 returns to the original starting position, the above described copying operation is repeated, which copying operation can be stopped by opening the printing switch $SW_1$ after the copying operation for the last copy paper sheet has started. For effecting the continuous copying described above, conventional counters for setting the number of copies to be made can be employed.

Figure 15:
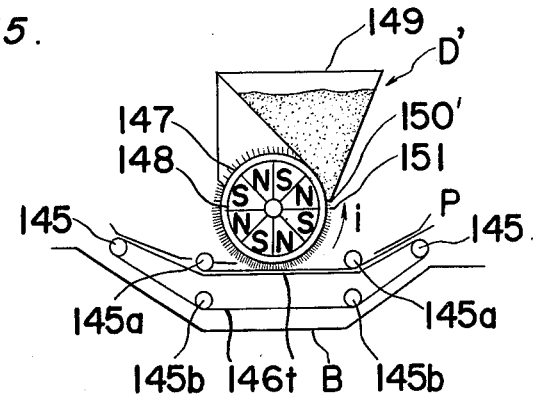
FIG. 15 is a schematic diagram showing a sectional side view of a dry type developing device applicable to the copying apparatus in FIG. 1.

Although, in the above embodiment of the copying apparatus of the invention, the wet type developing device D having the electrode rollers 41 and 42 is employed, it should be noted that a dry type developing device, for example, a device D′ as shown in FIG. 15 can be adopted instead of the wet type developing device D.

Referring to FIG. 15, the dry type developing device D′ comprises a cylinder 147 which is fixedly provided above an endless belt 146 for transporting the copy paper sheet p movably supported by two rollers 145 and suitably urged downward by a pair of rollers 145*a* and another pair of rollers 145*b* rotatably mounted on the forward run and the backward run of the endless belt 146, respectively, with the two rollers 145*a* and the two rollers 145*b* in each of such pairs disposed at a predetermined interval to form a flat portion of the endless belt 146 therebetween, a plurality of magnets 148 rotatably disposed in clyinder 147 and a funnel shaped tank 149 for dispensing toner powder fixedly mounted above the drum 147.

The plurality of magnets 148 enclosed in the cylinder 147 are disposed close to the surface of the forward run of the endless belt 146 and are adapted to rotate in the direction of arrow *i,* while an opening 150′ is formed at the lower portion of the tank 149 for uniformly supplying toner powder onto the surface of the cylinder 147. The toner powder thus supplied is formed into an arrangement resembling brush bristles 151 on the surface of said cylinder 147 by the action of the magnets 148.

The copy sheet fed onto the forward run of the belt 146 at the right of the device D' in FIG. 15 is further transported to the developing position *t* immediately below the cylinder 147 as the belt 146 moves, in which position *t* the copy paper sheet bearing an electrostatic latent image formed thereon is slightly rubbed by the brush bristles 151 with the latent image visualized by the adhesion of the toner powder to the charged portion thereof, and further fed into the subsequent processing station, such as the fixing device F. The toner particles remaining on the cylinder 147 after passing the exposure position *t* are carried back to a position in the vicinity of the opening 150' of the tank 149 as the magnets 148 rotate and are replenished with fresh toner from the tank 149 so as to again form brush bristles 151 with uniform tone concentration.

As is clear from the above description, in the copying apparatus of the present invention, the photoreceptor drum which has conventionally required a large space is reduced in diametral size to an optically possible extent with one copying cycle adapted to be completed by more than one revolution of the drum.

Similarly, various processing devices such as the corona charger, the exposure means, the transfer device and the charge erasing means etc., arranged sequentially around the photoreceptor drum are not only minimized, but efficiently disposed, so that the copying apparatus can be compact in size and light in weight.

Furthermore, since the housing of the copying apparatus of the invention is adapted to be divided into two portions, i.e. the upper frame including the latent image forming means such as the platform for the original, the optical system and the photoreceptor drum, and the lower frame including the copy paper feeding device, the transfer device, the developing device and the drying and fixing device, etc., which upper frame is pivotally connected to the lower frame so that the former can be raised or lowered about the pivotal connection, exchanging of the photoreceptor drum and other parts which may become deteriorated or worn out after predetermined periods of time can be effected very easily, and should jamming of a copy paper sheet occur during operation of the apparatus, the faulty sheet can be readily removed.

Since various parts and devices are easily accessible as described above, the copying apparatus of the invention is very advantageous both to the user and the manufacturer from the viewpoint of maintenance.

It is another important feature of the copying apparatus of the invention that the dry type developing device can be employed in the apparatus by minor alterations of the associated mechanisms.

If the drying and fixing device comprising the cylinder with the heater enclosed therein and a belt or a plurality of rollers having surfaces of air permeable materials is incorporated in the copying apparatus of the invention, very efficient drying and fixing of the copied paper sheets can be achieved.

Moreover, the adoption of the transparent or semi-transparent casing for the roll of copy paper is very advantageous in confirming the presence and the sizes of copy paper sheets for efficient copying operations.

Figure 16:
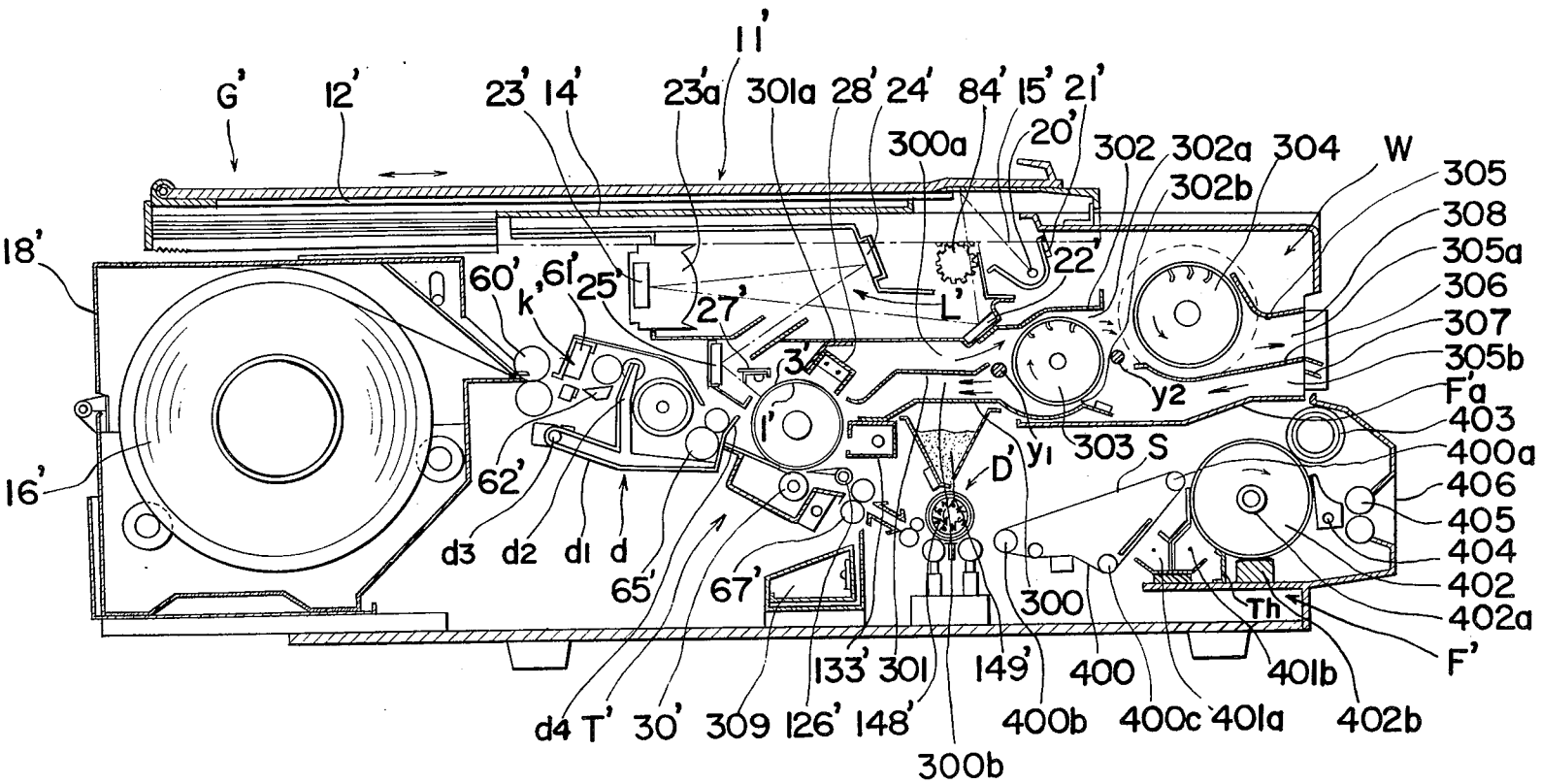
FIG. 16 is a schematic diagram showing a sectional side view of a copying apparatus according to a second embodiment of the present invention.

Referring now to FIG. 16, there is shown a second embodiment of the copying apparatus of the dry developing process type according to the present invention. As compared with the copying apparatus of FIG. 1, major differences in construction of the apparatus G' of FIG. 16 are in the transfer device, the fixing device and the inclusion of a transferred image disturbance prevention device, apart from minor alterations in the configuration of various other parts, so that constructions and functions of such other parts which are generally indicated by similar numerals, but with primes, to those of FIG. 1 are not illustrated in detail for the sake of brevity. In this embodiment of FIG. 16 also, the copy paper feeding means is arranged along a substantially V-shaped path with the developing means disposed approximately at an apex of the V-shaped path in a manner similar to that in the apparatus of FIG. 1. The operation of the apparatus of FIG. 16 may be briefly summarized as follows. Upon turning on a print switch (not shown), driving means (not shown) is energized for rotating the feeding rollers 60' and the photoreceptor drum 1' with the web of copy paper from the roll 16' being fed into the apparatus G' through the rollers 60'. A copy paper detecting actuator d has a base portion $d_1$ extending along the path of the copy paper, a first detecting projection $d_2$ extending upwardly at approximately right angles from the central portion of the base portion $d_1$ between the cutting device *k'* and the rollers 65', and a second detecting projection $d_4$ also extending upwardly from one base edge portion of base portion $d_1$ between the rollers 65' and the transfer device T', while the other edge of the base portion $d_1$ is pivotally supported, as at $d_3$, by a frame (not shown) of the apparatus housing for pivotal movement of the detecting actuator *d*. Upon depressing of the first detecting projection $d_2$ by the leading edge of the copy paper web, the detecting actuator *d* is turned clockwise about the pivotal point $d_3$ to actuate a leading edge detection switch (not shown). During the passage of the copy paper therethrough, the detecting actuator *d* remains depressed until the trailing edge of the copy paper cut to the predetermined length by the cutting device *k'* has passed through the second detecting projection $d_4$, when the actuator d pivots counterclockwise about the pivotal point $d_3$ to return to the original position for closing the leading edge detection switch.

When the leading edge detection switch (not shown) is actuate in a manner as described above, the platform 11' is caused to start moving, with the light source 20' turned on, thus the light image of the original to be copied is projected onto the photoconductive photoreceptor surface 3' of the photoreceptor drum 1' which is preliminarily charged by the corona charger 28' through the optical system L' including the mirrors 22', 23', 24' and 25' for forming the electrostatic latent image of the original on the photoreceptor surface 3'. The copy paper is fed in synchronization with the movement of the latent image formed on the photoreceptor drum 1' and is pressed, at a transfer device T' mentioned later, against the photoreceptor surface 3' by an electrically conductive grounded roller 30' so as to induce a charge having the same polarity as that of the latent image on an insulating layer of the copy paper for transferring the latent image onto the copy paper. Subsequently, the web of copy paper is cut to a predetermined length by the cutter *k'* having the blades 61' and 62' with the feeding rollers 60' stopped. The copy paper sheet thus cut passes through the transfer device T' and is separated from the photoreceptor surface 3' by the separating claw 126' to be further fed into the dry type developing device D' (equivalent to the device of FIG. 15) whereat the transferred latent image on the copy paper sheet is developed into a visible toner powder image, and thereafter is dried at a fixing device F' by heating means for completing the copying operations.

Figure 17:
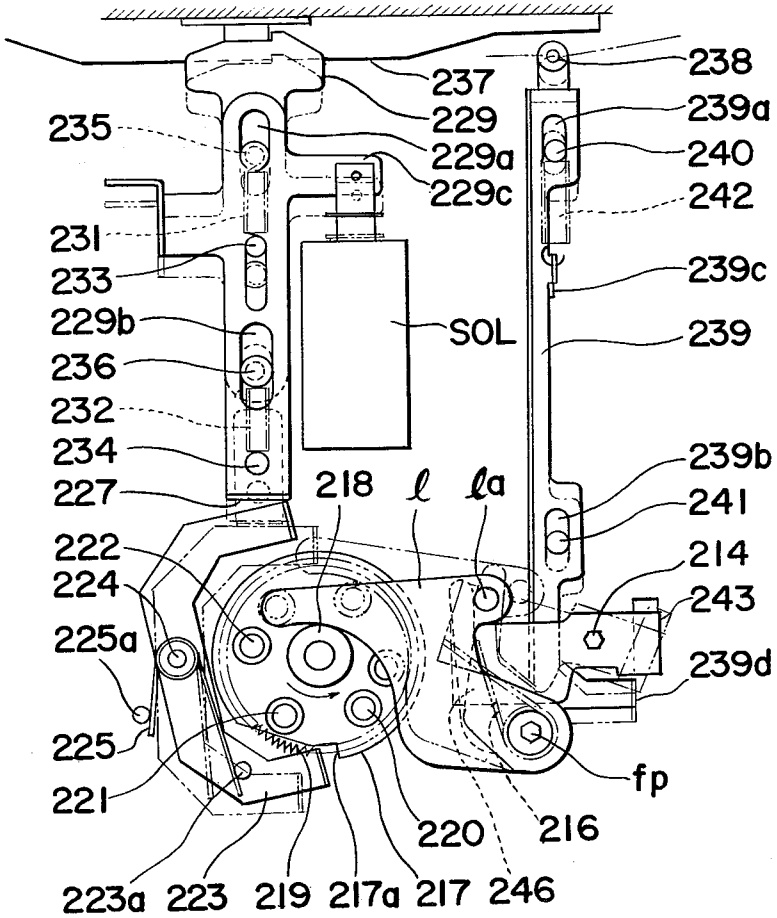
FIGS. 17(a) to 17(c) are schematic diagrams showing sectional side views, each on an enlarged scale, of a transfer device and associated mechanisms thereof employed in the copying apparatus of FIG. 16.
FIG. 17(d) is an exploded view showing various parts and components associated therewith of the transfer device of FIGS. 17(a) to 17(d) arranged in the order of their assembly.
Figure 17:
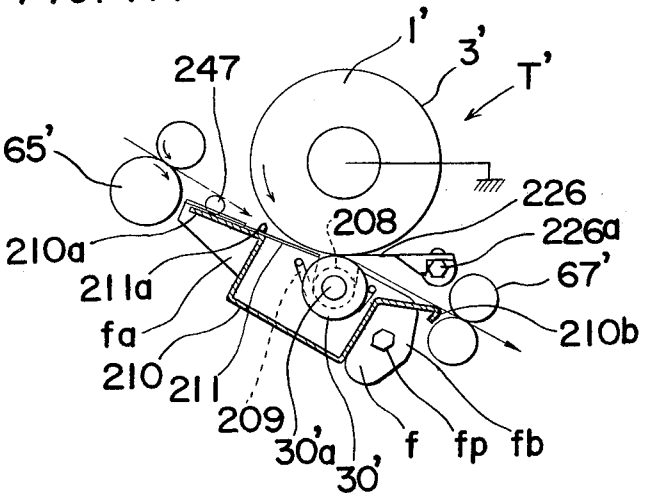
Figure 17:
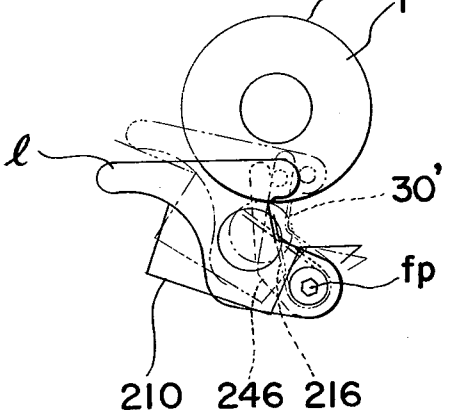
Figure 17:
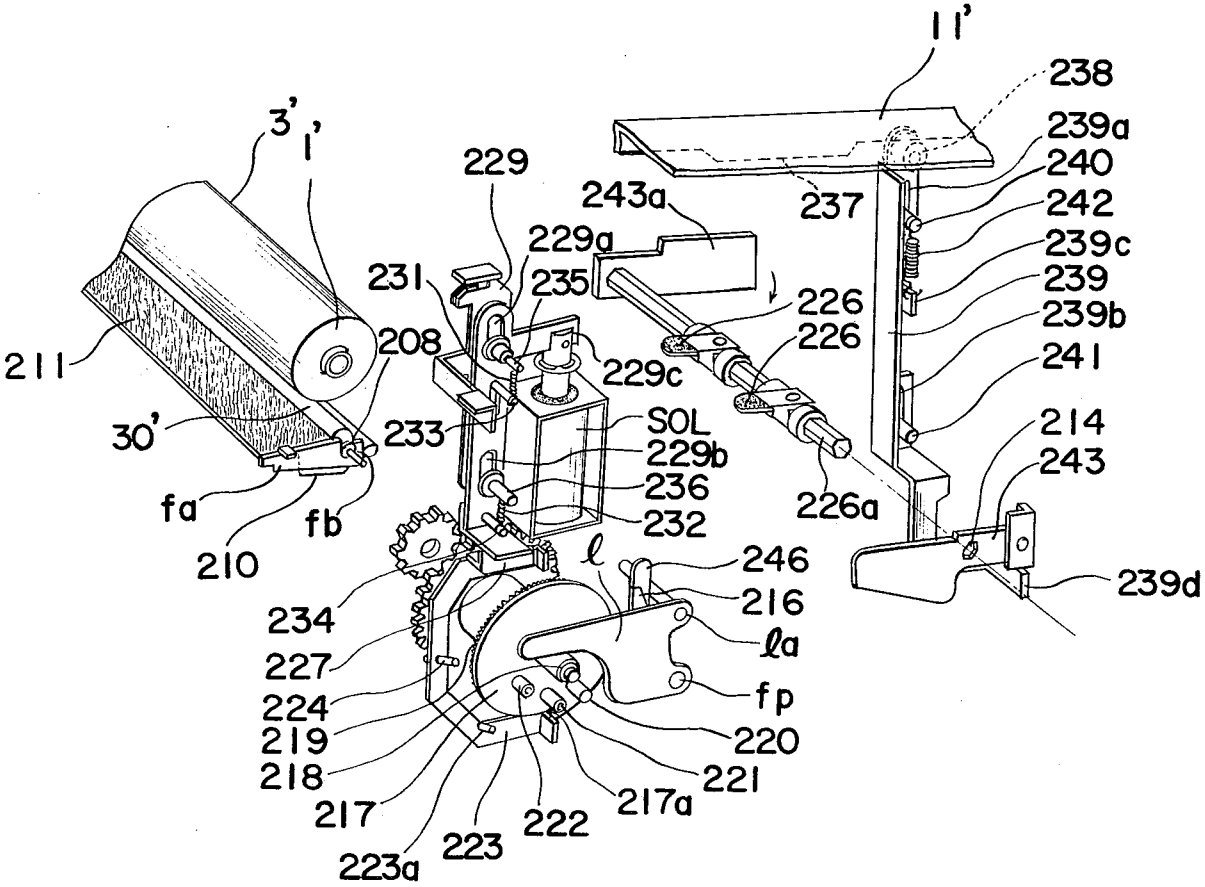
Figure 18:
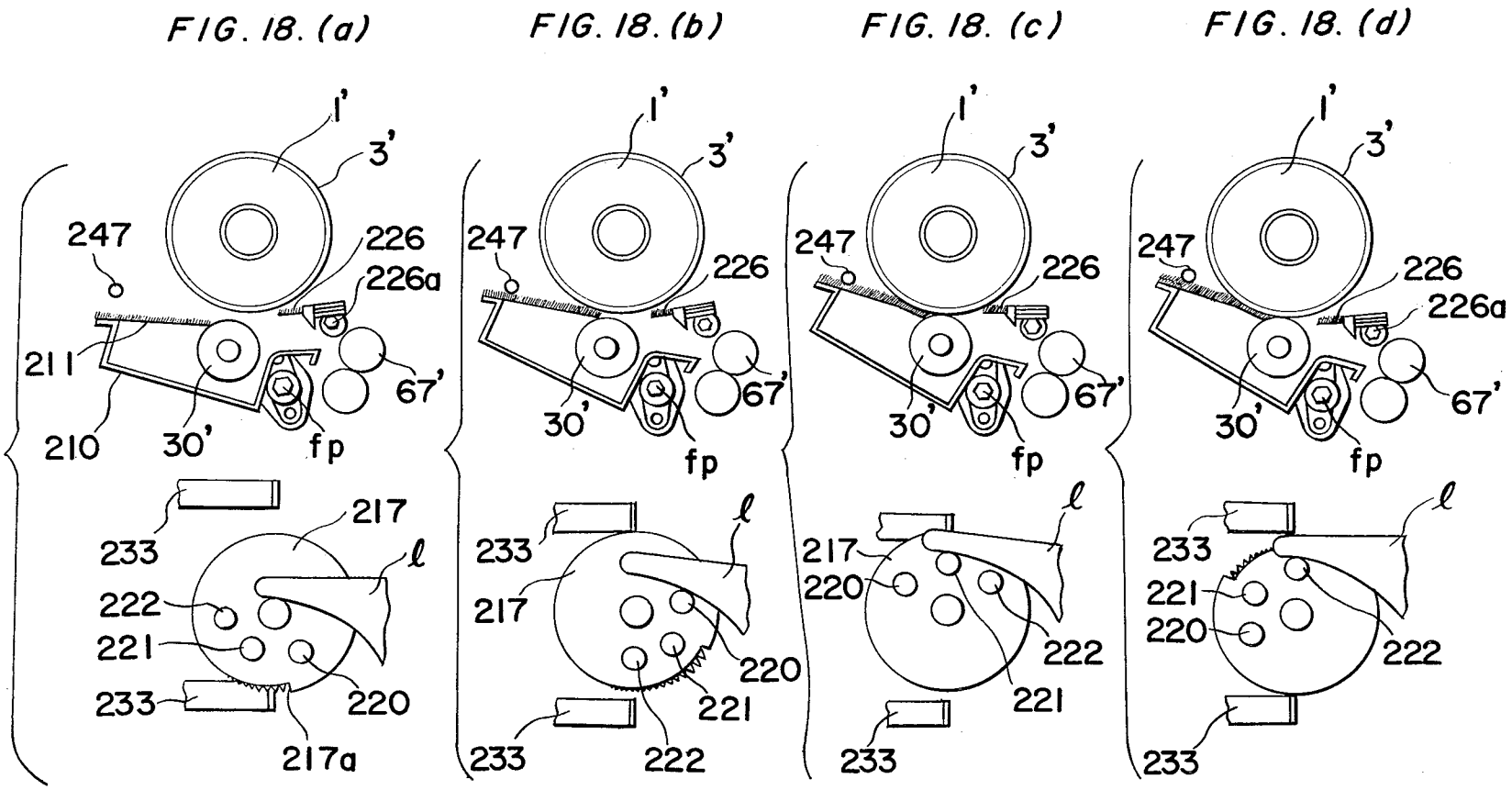
FIGS. 18(a) to 18(d) are views similar to FIG. 17(a), but particularly show the sequence of operations thereof.

Referring also to FIGS. 17(a) to 18(d), in the transfer device T' employed in the above embodiment of FIG. 16, the insulating roller 29 and the conductive roller 30 having the belts 31 directed therearound described as employed in the apparatus of FIG. 1 are replaced by a transfer frame *f* which includes a pair of spaced frame plates *fa* of triangular configuration and a frame member 210 of U-shaped cross section and suitably secured at end portions thereof to the frame plates *fa* in a direction parallel to the axis of the drum 1'. Each of the frame plates *fa* is pivotally supported, at one edge portion *fb* thereof, by a pin or shaft *fp* secured to a frame (not shown) of the apparatus housing G' for pivotal movement toward and away from the photoreceptor surface 3' of the drum 1', while the pivotal movement thereof toward the surface 3' is limited by a stop pin 247 fixedly disposed at the lower left-hand portion of the drum 1', on each of which frame plates *fa*, there are mounted in a bearing 208 suitably grounded and adapted to be slidably movable in a corresponding notch formed in the frame plate *fa* for upward and downward movements, and a grounded roller or an electrically conductive transfer roller 30' rotatably supported by and electrically connected to the bearing 208 through a shaft 30'a of the roller 30', while the bearing 208 is in turn supported by a substantially V-shaped wire spring 209 which is suitably secured to the plate *fa*, so that the bearing 208 together with the roller 30' are urged upward to the photoreceptor surface 3' as seen in FIG. 17(a). One upper edge portion 210a of the frame member 210 adjacent to the rollers 65' extends leftwardly at approximately right angles to the side of the member 210 with the upper surface of the edge portion 210a being in parallel with the upper edges of the plates *fa*, while the other edge 210b of the member 210 extends rightwardly, toward the rollers 67' as in FIG. 17(a). On the surface of the edge 210a of the frame member 210, a flexible guide plate 211 which is operated by mechanisms mentioned later is secured, with the front free edge of the plate 211 extending close to the roller 30' into such a position that, while the roller 30' is pressed against the photoreceptor surface 3' of the drum 1', the copy paper contacting the photoreceptor surface 3' is fed between the roller 30' and the photoreceptor surface 3'. Furthermore, in order to prevent damage to the photoreceptor surface 3', brush bristles 211a composed of fibers of electrically insulating nature are secured on the surface of the guide plate 211. At the upper right-hand portion of the roller 30' adjacent to the photoreceptor surface 3' of the drum 1', a separating claw 226 is pivotally supported by a shaft 226a, on a frame (not shown) of the apparatus housing G'.

Referring particularly to FIGS. 17(b) to 17(d) the mechanisms for operating the transfer frame *f* and the separating claw 226 in association with the copying operation are described hereinbelow. The mechanisms press the guide plate 211 and the grounded roller 30' against the photoreceptor surface 3' only when the copy paper passes therebetween, and also cause the separating claw 226 to function in synchronization with the movement of the leading edge of the copy paper, since the photoreceptor surface 3' tends to be damaged, or the surface 3' and the grounded roller 30' are worn out rapidly if the plate 211, the roller 30' and the claw 226 are always kept in contact with the photoreceptor surface 3'. On one end of the shaft *fp* for the transfer frame *f*, a lifting lever *l* is rotatably mounted at one end portion thereof, while a transfer frame operating lever 246 is fixedly mounted on the shaft *fp* for simultaneous rotation therewith, so that rotation of the lever *l* is transmitted to the lever 246 through a torsion spring 216 suitably disposed therebetween. A cam member 217 of circular configuration disposed adjacent to the lifting lever *l* is adapted to rotate integrally with a gear member 219 and is in frictional engagement with a rotational axis 218 thereof. Pins 220, 221 and 222 spacedly disposed to one another and extending upwardly at right angles from the surface of the cam member 217 are adapted to engage the other end of the lever *l* and turn the same lever *l* clockwise as the cam member 217 rotates in the direction of the arrow in FIG. 17(c). The cam member 217 has a cut or stepped portion 217a at an outer periphery thereof, at which portion 217a the teeth of the gear member 219 are exposed out of the cam member 217. A U-shaped lever 223 is pivotally supported at the central portion thereof, by a pin 224 on a frame (not shown) of the apparatus housing G', while a V-shaped wire spring 225 (FIG. 17(c)) is disposed between a pin 225a suitably secured to the housing G' and a pin 223a fixed to the lever 223 for urging the lever 223 counterclockwise. The upper end of the U-shaped lever 223 is adapted to contact an elastic member 227 secured to the lowrr end of a stop lever 229 for the platform 11'. The lever 229 disposed in a direction normal to the surface of the platform 11' has a laterally projecting portion 229c to which a solenoid SOL is connected, and pins 233 and 234 fixed to the lever 229, while elongated openings 229a and 229b are formed in the lever 229 along the vertical axis thereof, in which openings 229a and 229b, stop pins 235 and 236 secured to the apparatus housing G' are slidably received, with the lever 229 being normally urged upward by springs 231 and 232 disposed between the pins 235, 233 and 236, 234 respectively, so that when the stop lever 229 is pulled downwardly upon actuation of the solenoid SOL, the elastic member 227 at the lower end of the lever 229 depresses the upper edge of the U-shaped lever 223 against the urging force of the spring 225 for rotating the lever 223 clockwise so that the lower edge of the lever 223 is released from the gear 219. At the lower surface edge of the platform 11', there is provided a separating claw operating cam 237, which is formed in such a shape as to contact a separating claw operating roller 238 rotatably disposed at the upper-most portion of a lever 239 mentioned below. The lever 239 disposed at the right-hand portion in FIGS. 17(c) and 17(d) in a direction parallel to the axis of the lever 229 is formed with elongated openings 239a and 239b along the vertical axis thereof, in which openings 239a and 239b, stop pins 240 and 241 suitably to the apparatus housing G' are slidably received for supporting the lever 239, while the lever 239 is urged upward through a spring 242 suitably stretched between the pin 240 and a projection 239c of the lever 239. The lower portion of the lever 239 has a laterally projecting catch portion 239d, which normally engages a separating claw operating lever 243 disposed adjacent to the lifting lever *l* and pivotally supported by one end of the separating claw shaft 226a as at 214 for limiting the rotation of the lever 243 normally urged clockwise by an adjustable weight or balancer 243a (FIG. 17(d)) which is fixed to the other end of the claw shaft 226a. Upon lowering of the lever 239 and consequently of the projecting 239d, the lever 243 released from the catch portion 239d of the lever 239 turns clockwise about the pivotal point 214 and contacts a pin *la* fixed on the lifting lever *l* so as to be limited from further rotation.

By this arrangement, the functions of the above mechanisms are described hereinbelow in association with the copying operations.

Upon depression of a print button (not shown), the shaft 218 for the cam member 217 and the gear 219 starts rotaing with rotation of the main motor M (not shown), the copy paper feed rollers 60' (FIG. 16) and the photoreceptor drum 1', and with consequent feeding of the copy paper, in which case, various elements of the above described mechanisms are in positions shown by the solid lines in FIG. 17(c), while the lower end of the U-shaped lever 223 is in the stepped portion 217*a* of the cam member 217 and engaged with the gear 219 without any relative movements therebetween, with the transfer frame *f* together with the guide plate 211 and the grounded roller 30' thereof being spaced away from the photoreceptor surface 3' of the drum 1'. When the leading edge of the web of the copy paper strikes against the copy paper detection portion $d_2$ of the actuator *d* disposed along the path of the copy paper, a leading edge detection switch (not shown) is turned on, which switch in turn actuates the solenoid SOL so as to pull the platform stop lever 229 downward, and simultaneously the platform 11' starts moving rightward in FIG. 17(c). Referring particularly to FIGS. 18(a) to 18(c), in the above case, the elastic member 227 provided at the lower end of the stop lever 229 depresses the upper end of the U-shaped lever 223 for rotating the same clockwise, with the lower edge of the lever 223 which is located in the stepped portion 217*a* being disengaged from the gear 219 and released therefrom, by which action, the cam member 217 which is in frictional engagement with the shaft 218 starts rotating and the pin 220 secured on the member 217 initially contacts the lifting lever *l* for rotating the lever *l* clockwise, with the transfer frame shaft operating lever 246 being consequently turned clockwise through the torsion spring 216. Consequently, the tranfer frame *f* is pivoted integrally with the rotation of the transfer frame shaft *fp* until it stops by engaging the stop pin 247 as is shown in FIG. 18(b), in which case, any mechanical error in the amount of rotation of the frame *f* is adapted to be absorbed by the torison spring 216. Meanwhile, the cam member 217 continues to rotate, and when the stepped portion 217*a* of the member 217 has reached a position where the member 217 has made approximately a half turn, the upper end of the lever 223 depressed by elastic member 227 of the lever 229 will fall into the stepped portion 217*a* so as to be engaged with the exposed portion of the gear 219, with relative movement therebetween being restricted as shown in FIG. 18(c), in which state, the transfer frame *f* is continuously held in the same position, with the guide plate 211 and the grounded roller 30' pressed against the photoreceptor surface 3' of the drum 1', since the pin 221 of the member 217 is kept in contact with the lifting lever *l* as shown in FIG. 18(c).

In the above state, the copy paper is fed between the roller 30' and the photoreceptor surface 3' through the guide plate 211, and, at the front portion of the guide plate 211, contacts the surface 3' bearing the latent image of the original placed on the platform 11', while the platform 11' is moving in synchronization with the rotation of the drum 1'. The copy paper is further pressed against the surface 3' by the roller 30' for transferring the latent image on the surface 3' onto the copy paper.

Following the movement of the platform 11', the separating claw operating cam 237 contacts the roller 238 of the lever 239 for depressing lever 239 and consequently the projecting portion 239*d* thereof, which permits the separating claw operating lever 243 which had been limited from rotation by the portion 239*d* to rotate clockwise by the weight of the balancer 243*a* (FIG. 17(d)) for simultaneous rotation with the separating claw rotating shaft 226*a*. Consequently, the tip of the claw 226 contacts the photoreceptor surface 3' as shown in FIG. 18(c) for separating the leading edge of the copy paper from the latter, in which state, the lever 243 restricted in its rotation by contact with the stop pin *la* of the lifting lever *l* is released from the stop pin *la* which is in a position as is shown by the dashed lines in FIGS. 17(b) and 17(c). It is to be noted that the claw 226 contacts the photorector surface 3' only during contact of the projecting portion of the separating claw operating cam 237 with the roller 238 of the lever 239.

When the trailing edge of the copy paper sheet passes the second detecting projection $d_4$ of the copy paper detecting actuator *d* (FIG. 16), the actuator *d* returns to its original position, with the leading edge detecting switch and the solenoid SOL turned off, while the platform stop lever 229 is raised by the urging force of the springs 231 and 232 with consequent releasing of the U-shaped lever 223 from the elastic member 227. The lever 223 thus released from the depression by the stop lever 229 turns counterclockwise and is disengaged from the stepped portion 217*a* of the cam member 217 so as to permit the cam member 217 and the gear 219 to rotate again. Although transfer at the trailing edge of the copy paper sheet has not been completed upon rotation of the cam member 217 and the gear 219, the transfer frame *f* remains stationary until the pin 22 of the cam member 217 is disengaged from the lifting lever *l*, and after the trailing edge of the copy paper has passed the grounded roller 30', the pin 222 leaves the lifting lever *l*, with the transfer frame *f* returned to its original position and with the guide plate 211 and the grounded roller 30' disengaged from the photoreceptor surface 3'. Thereafter, the end of the U-shaped lever 223 contacting the periphery of the cam member 217 by the urging force of the spring 225 falls into the stepped portion 217*a* of the cam 217 for stopping rotation of the cam member 217 and the gear 219, which state is maintained until a subsequent signal through the leading edge of the copy paper sheet is received In the returning movement of the platform 11', the separating claw operating cam 237 again contacts the roller 238 of the lever 239 for depressing the lever 239, in which case, however, the separating claw 226 does not contact the photoreceptor surface 3', since the rotation of the separating claw operating lever 243 is limited by the contact thereof with the stop pin *la* of the lever *l* which is lowered in the above state as shown by the solid line in FIG. 17(c).

As is seen from the foregoing description, in the transfer device T' of FIGS. 17(a) to 18(d), there is employed the guide plate 211 at least the upper surface of which is of electrically insulating nature and which causes the copy paper to contact the photoreceptor surface 3', as the plate 211 guides the copy paper between the photoreceptor surface 3' and the conductive grounded roller 30', by which arrangement, the copy paper is positively pressed against the photoreceptor surface 3' of the drum 1' by the guide plate 211, before the copy paper sheet being transported is held between the grounded roller 30' and the photoreceptor surface 3' without any possibility of the copy paper sheet being separated from the photoreceptor surface 3' between the guide plate 211 and the roller 30'. Thus fogging or blurring of the image at the transfer station or the absence of a black tone in the transferred image due to electrical discharge is advantageously eliminated. Furthermore, the brush bristles 211*a* secured to the upper surface of the guide plate 211 are also very effective for cleaning the photoreceptor surface 3' as the former contacts the latter surface 3', which fact contributes greatly to the prevention of the deterioration of the photoreceptor surface and eliminates disadvantages inherent in the conventional devices wherein the photoreceptor surface is subjected to harmful gases such as ozone generated by the corona charger or the like and tends to be readily deteriorated.

Referring back to FIG. 16, the copying apparatus G' of the invention is further provided with a prevention device W for preventing disorder or disturbance of the transferred image resulting from the gradual deterioration of the photoreceptor surface 3' due to accumulation of harmful gases such as ozone, nitrogen oxides and the like which are generated following discharge by the corona charger. The device W generally includes an air duct 300 disposed between the photoreceptor surface 3' and a fan 303, another air duct 305 provided between a fan 304 which is disposed adjacent to the fan 303 and a louver 307 attached to a discharge opening 308 of the apparatus housing G' for preventing mixing of the exhaust air with the suction air and a panel heater 309 of self-equilibrium type disposed below the photoreceptor drum 1'. The duct 300 is divided into a suction duct 300*a* and an injection duct 300*b* by a partition plate 301 provided therein, with one end portion of the suction duct 300*a* adapted to enclose the corona charger 28' therein, while the other end portion 302 of the duct 300 surrounded by arcuate upper and lower walls of the duct 300 defines a space in which the fan 303 is rotatably housed and forms a suction passage 302*a* and an injection passage 302*b* between the upper and lower walls of the duct 300. Separator members $Y_1$ and $Y_2$ for air flow are each disposed between the fan 303 and a corresponding edge of the partition plate 301 and between the fan 303 and the fan 304. The air duct 305 is also divided into an exhaust duct 305*a* and a suction duct 305*b* by a partition plate 306, with the fan 304 rotatably disposed adjacent to one end portion of the exhaust duct 305*a* remote from the discharge opening 308. The panel heater 309 is adapted to be energized upon insertion of a plug of the copying apparatus (not shown) in the power source receptacle (not shown) for constantly maintaining the temperatures on the photoreceptor surface 3' in the range from 40° to 50° C, so that, during suspension of copying operations, the reduction of charge holding capacity of the photoreceptor surface 3' due to adborption of moisture is prevented.

By this arrangement, upon turning on the main switch (not shown) for copying operation, the fans 303 and 304 start rotating, and the outside air is sucked in through the duct 305*b* and injected toward the underside of the corona charger 28' through the injection duct 300*b*, while the air in the duct 300*a* is discharged out of the apparatus G' through the duct 305*a* together with the air heated by the light source 20' by the action of the fan 303 backed up by the fan 304. Accordingly, the air injected through the duct 300*b* fully passes through the interior of the corona charger 28' by the suction of the duct 300*a* and by the presence of an air flow shield member 301*a* fixed to the charger 28' without being drawn toward other portions in the vicinity of the exposure surface 3'. Thus any harmful gases, such as ozone, nitrogen oxides and the like existing within the corona charge 28' and thereabout are efficiently discharged out of the apparatus G' through the opening 308 and the louver 307.

It should be noted that the fan 303 described as employed in the above device W may be replaced by two fans each exclusively used for air flow suction and injection, and that the direction of air flow may be reversed, i.e., from the side of the corona charger 28' toward the photoreceptor 3'. Still referring to FIG. 16, the copy paper sheet bearing a visible toner powder image thereon developed by the developing device D' is further fed into a fixing device F' through a copy paper transportation belt 400 movably supported by a driving roller 400*a*, and rollers 400*b* and 400*c*. The belt 400 has an electrically high resistant layer, for example, of Teflon thereon and is adapted to be uniformly charged by a corona charger 401*a* integrally formed with a corona charger 401*b* and disposed below and adjacent to the belt 400 to charge the belt 400 for electrostatically attracting thereto the copy paper to be transported. Adjacent to the roller 400*a* for the belt 400, there is rotatably provided a cylinder or a drum 402 for carrying the copy paper fed from the belt 400 through electrostatic attraction and heating the same from its reverse side. The drum 402 is composed of heat conductive material such as an aluminum cylinder formed, on the outer periphery thereof, with a heat resisting high resistant layer such as Teflon, and is adapted to be uniformly charged with the corona charger 401*b*. Within the drum 402, there is disposed a quartz infrared lamp 402*a*, while the drum 402 is caused to rotate in the direction shown by the arrow in synchronization with the movement of the belt 400 through a driving source (not shown). It should be noted that the flat belt surface S between the rollers 400*a* and 400*b* is disposed in the tangential direction to the drum 402 for preventing any inconveniences which may occur when the copy paper is separated from the surface of the belt 400 and passed onto the surface of the drum 402. It is preferable that both sides of the drum 402 be closed by suitable heat shielding material (not shown) with inner periphery of the drum 402 being treated for good heat absorption so that warming-up time for the fixing device F' can be reduced. It is to be noted that the infrared lamp 402*a* described as employed in the device F' of FIG. 16 may be replaced by a heating member having a flat surface and disposed along the inner face of the drum 402, and that the position of the lamp 402*a* is not limited to be within the drum 402, but the lamp 402*a* may be disposed outside of the drum 402 so far as the lamp 402*a* does not directly heat the copy paper through heat radiation, in which latter case, however, the drum 402 is preferably of a heat insulating nature. A pressing roller 403 rotatably provided at the right upper portion of the drum 402 contacts the outer periphery of the drum 402 for synchronous rotation therewith, and is composed of material such as silicon rubber having no adhesion to toner particles and simultaneously having heat insulating properties. Below the roller 403 in a position adjacent to the surface of the drum 402, there is pivotally disposed a separating claw 404 of metallic material for separating the copy paper from the surface of the drum 402 and for subsequently guiding the separated copy paper toward a pair of discharge rollers 405 disposed adjacent to a discharge opening 406 of the apparatus housing G'. A thermistor W disposed adjacent to the lower portion of the surface of the drum 402 is substantially in sliding contact with the latter so as to control the function of the lamp 402*a* for constantly maintaining the surface temperature of the drum 402 at a predetermind level.

Furthermore, a cleaning pad 402*b* made of material such as felt is disposed on the frame below the drum 402 in contact with the surface of the drum for cleaning toner particles adhering thereto from the reverse face of the copy paper. The upper portion F'*a* of the device F' is composed of heat insulating material for improving thermal efficiency of the fixing device F'. In the above described fixing device F', a separate heating source which is energized only during the warming-up period may be provided for the roller 403 in order to increase the speed of the temperature rise at the initial stage of the copying operation and thus to reduce the warming-up time. For ensuring separating of the copy paper from the surface of the drum 402, the separating claw 404 should preferably be of a type in part of the front edge portion thereof is received in narrow grooves (not shown) formed around the outer periphery of the drum 402.

It should be noted here that the above described fixing device F' of the invention may be used as a drying and fixing device for copy paper developed through the wet developing process as in the copying apparatus G of FIG. 1, in which case, the roller 403 described as employed in the embodiment of FIG. 16 may be replaced by a roller having brush bristles (not shown) secured on the outer periphery thereof.

By this arrangement, the copy paper sheet bearing an unfixed toner powder image on the surface thereof is electrostatically attracted and carried by the belt 400, and is separated by its own resilience from the belt 400 at the portion of the roller 400*a* so as to be subsequently attracted onto the surface of the drum 402 electrostatically. The copy paper sheet thus attracted onto the surface of the drum 402 is subjected to heat condition from the reverse surface thereof until the same is held between the roller 403 and the drum 402, and is heated to such an extent that the toner powder image thereon is partly fixed so as to withstand any slight mechanical contact thereof with other parts. Between the roller 403 and the drum 402, the toner powder image is completely fixed on the copy paper sheet through heat conduction from the roller 402, with the surface of the fixed toner powder image being smoothed by the pressure therebetween. The fixed copy sheet is subsequently separated from the surface of the drum 402 by the claw 404 and discharged out of the apparatus G' through the rollers 405.

As is clear from the foregoing description, according to the fixing device F' of the invention, the copy paper sheet bearing the toner powder image formed thereon is electrostatically attracted onto the drum 402 provided with the heating source 402*a*, and is initially heated to such an extent that the toner powder image is partly fixed merely through heat conduction from the reverse surface of the copy paper sheet, while the sheet is being transported as the drum 402 rotates. The copy paper sheet is then passed between the drum 402 and the roller 403 of heat insulating nature which contacts the drum 402 under low pressure and rotates following the rotation of the drum 402 for perfectly fixing the toner powder image on the copy paper sheet, by which arrangement, the possibility of ignition of the copy paper sheet due to excessive heating is eliminated, since radiation heat of the heating source is not directly applied to the surface of the copy paper sheet, while prevention of offset of the toner powder image and improvement in the durability of the roller 403 are advantageously achieved, because the toner powder image is adapted to be fixed on the copy paper sheet under slight pressure after the same has been semi-fixed. Furthermore, by the above arrangement, fixing of a copy paper sheet having a specially treated surface thereon may be effected without rumpling or wrinkling of the copy paper sheet. Additionally, the simple construction of the fixing device F' which requires only a single heating source or control means therefor contributes greatly to the reduction of space when incorporated in the copying apparatus.

Figure 19:
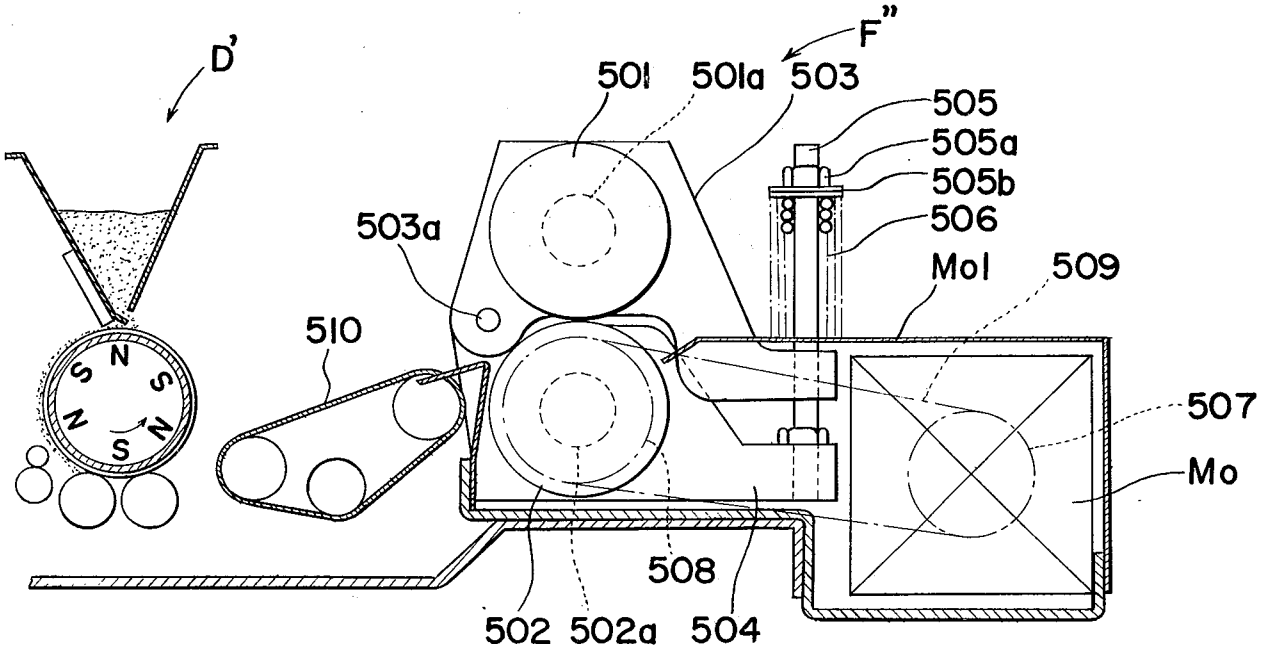
FIG. 19 is a schematic diagram showing, on an enlarged scale, a sectional side view of a modification of the fixing device and an associated device employed in the apparatus of FIG. 16.

Referring now to FIG. 19, there is shown a modification of the fixing device F' of FIG. 16. In this modification, the fixing device F'' for use in a copying apparatus of the dry developing process type is intended to fix the toner powder image only through pressure without utilizing any heat. The fixing device F'' generally includes a pair of pressing rollers 501 and 502 of metallic material each heat-treated to increase the hardness thereof and rotatably supported on frames 503 and 504 by corresponding shafts 501*a* and 502*a*, with the upper frame 503 being adapted, at one end thereof, to pivot about a pin 503*a* fixed on a frame of the apparatus housing, while the lower frame 504 is suitably fixed and remains stationary. A bolt 505 passes through a notch or an opening formed at the other end of the frame 503 with the lower end of the bolt 505 being threaded into an internally threaded opening formed at the other end of the frame 504 and secured thereto by a nut. The upper threaded end of the bolt 505 engages a nut 505*a*, and a torsion spring 506 is coaxially disposed in the portion of the bolt 505 between a washer 505*b* disposed below the nut 505*a* and the upper wall of a housing Mol for a driving motor Mo which is adapted to engage the upper surface of the notched end of the frame 503 when the spring 506 is compressed. The spring 506 provided for pressure adjustment between the rollers 501 and 502, and if there is a tendency to unsatisfactory fixing, the nut 505*a* is further turned and threaded into the bolt 505 to compress the spring 506 for rotating the upper frame 503 clockwise in FIG. 19 about the pivotal connection 503*a* and consequently for further pressing the roller 501 disposed on the frame 503 against the roller 502 to adjust the pressure therebetween. A pulley 507 fixedly mounted on a driving shaft (not shown) of the motor Mo is connected to another pulley 508 secured to the shaft 502*a* of the roller 502 through a chain 509 for driving the roller 502, with the upper roller 501 being rotated following the rotation of the lower roller 502.

By this arrangement, the copy paper developed by the developing device D' and bearing the toner powder image thereon is transported on a belt 510 disposed between the developing device D' and the rollers 501 and 501, and movably supported by a plurality of rollers and is subsequently fed between the rollers 501 and 502. Thus the tone powder image is fixed on the copy paper sheet by the pressure acting thereon between the rollers 501 and 502.

In the fixing device F'' of FIG. 19, since no heating elements are employed for fixing, not only the danger of ignition of the copy paper sheet is completely eliminated, but also power consumption is reduced by an appreciable extent, and simple construction of the device F'' contributes to compact size and reduction of manufacturing cost of the copying apparatus.

As is clear from the foregoing description, according to the copying apparatus G' of the embodiment of FIG. 16, very efficient copying operations are carried out through the adoption of the improved transfer device T', the image disorder prevention device W for preventing the disturbance of the transferred image, and the fixing device F' of simple construction.

It should be noted here that the transfer device T' described as employed in the copying apparatus G' of the dry developing type of FIG. 16 can be readily incorporated in the apparatus G of the wet developing type of FIG. 1, instead of the transfer device T thereof, and that the image disorder prevention device W can also be built in the copying apparatus G of FIG. 1 with minor alterations in the associated mechanisms.

Although the present invention has been fully described by way of example with reference to the attached drawings, it is to be noted that various changed and modifications are apparent to those skilled in the art. Therefore, unless such changes and modifications otherwise depart from the scope of the present invention, they should be construed as included therein.

What is claimed is:

1. An electrophotographic copying apparatus of the electrostatic latent image transfer type, said apparatus comprising:

a reciprocatingly movable platform on which an original to be copied is placed;

a rotatable photoreceptor drum disposed below said platform and having a photosensitive surface onto which an image of the original is projected;

means disposed around said drum and including a corona charging means for applying charges uniformly onto said drum, an exposure slit means through which an image of the original is projected so as to form an electrostatic latent image on said photosensitive surface, an image transfer means for transferring the thus formed latent image onto a copying paper sheet, a separating means for separating said copying paper sheet from said drum, and an erasing means for erasing residual charges from said drum;

a paper feeding means for feeding a copying paper sheet along a path to said image transfer means;

a developing means for developing the copying paper sheet;

a fixing means for fixing the thus developed image;

means for detecting the arrival of a copying paper sheet at a predetermined location along said path;

shifting means for shifting said image transfer means between a first position in which said image transfer means is out of contact with said drum and a second position in which said image transfer means is in contact with said drum;

control means, actuatable by said detection means, for operating said shifting means for shifting said image transfer means from said first to second positions thereof; and locking means normally preventing said platform from movement, and actuatable by said detecting means to release said platform and allow movement thereof.

2. An electrophotographic copying apparatus as claimed in claim 1, further comprising cam means on said platform, a shifting member engaging said cam means and movable thereby, and said shifting member operably connected to said separating means to move the same between a first position out of contact with said drum and a second position in contact with said drum upon movement of said shifting member by said cam means.

3. An electrophotographic copying apparatus of the electrostatic latent image transfer type, said apparatus comprising:

a reciprocatingly movable platform on which an original to be copied is placed;

a rotatable photoreceptor drum disposed below said platform and having a photosensitive surface onto which an image of the original is projected;

means disposed around said drum and including a corona charging means for applying charges uniformly onto said drum, an exposure slit means through which an image of the original is projected so as to form an electrostatic latent image on said photosensitive surface, an image transfer means including at least an electrically conductive roller for transferring the thus formed latent image onto a copying paper sheet, a separting means including claw member for separating said copy paper sheet from said drum, and an erasing means for erasing residual charges from said drum;

a paper feeding means for feeding a copying paper sheet along a path to said image transfer means;

a developing means for developing the transferred image;

a fixing means for fixing the thus developed image;

means for detecting leading and trailing edges of the copying paper at predetermined locations along said path;

first control means for shifting said image transfer means between a first position out of contact with said drum and a second position in contact with said drum, said first control means including a shifting lever, a platform locking lever for locking said platform from moving, and a cam member rotatable by said shifting lever for shifting said image transfer means;

second control means for shifting said separating means between a first position out of contact with said drum and a second position in contact with said drum, said second control means including a shifting member operatively connected to said separating means and actuatable by a cam means on said platform during the movement thereof to shift said separating means;

said shifting lever and locking lever of said first control means being actuated upon detection of the leading edge of said copying paper sheet by said detecting means to release said locking lever and to rotate said cam member to thereby move said platform and shift said image transfer means; and said shifting member of said second control means being actuated as said platform moves by said cam means to shift said separating means to said second position thereof into contact with said drum.

* * * * *